US007517165B2

(12) United States Patent
Suzuki et al.

(10) Patent No.: US 7,517,165 B2
(45) Date of Patent: Apr. 14, 2009

(54) PRINTING UNIT WITH FRAME LOCKING MECHANISM AND RELEASE LEVER

(75) Inventors: Kuniyuki Suzuki, Nagano (JP); Jiro Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 73 days.

(21) Appl. No.: 11/159,386

(22) Filed: Jun. 23, 2005

(65) Prior Publication Data

US 2005/0286954 A1 Dec. 29, 2005

(30) Foreign Application Priority Data

Jun. 23, 2004 (JP) ..... P2004-184918
Jun. 28, 2004 (JP) ..... P2004-189860
Jun. 28, 2004 (JP) ..... P2004-189861

(51) Int. Cl.
*B41J 29/02* (2006.01)

(52) U.S. Cl. ..... 400/693; 400/613; 400/691; 347/108; 347/222

(58) Field of Classification Search ..... None
See application file for complete search history.

(56) References Cited

U.S. PATENT DOCUMENTS 2,540,297 A * 2/1951 Freeman et al. ..... 400/681
4,947,185 A * 8/1990 Mitsushima et al. ..... 347/222
5,694,159 A 12/1997 Kajiya et al.
5,779,371 A * 7/1998 Aoyama et al. ..... 400/120.16
5,909,226 A * 6/1999 Takeda ..... 347/3
6,068,419 A * 5/2000 Shiozaki et al. ..... 400/582
6,474,883 B1 11/2002 Kawakami et al.
6,607,322 B2 8/2003 Aruga et al.
6,789,969 B2 * 9/2004 Hirabayashi et al. ..... 400/693
2005/0007437 A1 * 1/2005 Shiota ..... 347/108

FOREIGN PATENT DOCUMENTS

EP 0 311 981 4/1989
EP 0 765 761 4/1997
JP 4-296569 10/1992
JP 9-123568 5/1997
JP 9-254461 9/1997
JP 10-250167 9/1998
JP 2000-118064 4/2000
JP 2001-205896 7/2001
JP 2002-11917 1/2002
JP 2002-145500 5/2002
JP 2002-154719 5/2002

* cited by examiner

*Primary Examiner*—Jill E. Culler
(74) *Attorney, Agent, or Firm*—Nixon & Vanderhye P.C.

(57) ABSTRACT

A first frame member has an accommodating section adapted to accommodate a rolled sheet at a rear side of the first frame member. A print head is operable to perform printing with respect to a part drawn out from the rolled sheet. A second frame member is provided with the print head and supported on a front side of the first frame member so as to be movable between a first position and a second position. A locking mechanism locks the second frame member at the first position. A release lever releases the locked state of the second frame member when the release lever is pulled toward the second frame member. User access with respect to at least the accommodating section is allowed when the second frame member is placed in the second position.

13 Claims, 23 Drawing Sheets

PRINTING UNIT WITH FRAME LOCKING MECHANISM AND RELEASE LEVER

BACKGROUND OF THE INVENTION

The present invention relates to a printing unit that is incorporated in an installation type information terminal such as a kiosk terminal or an automatic teller machine (ATM).

There are various kinds of installation type information terminals, such as a kiosk terminal that is installed in a railroad station, airport, a convenience store, or the like, an ATM, a counting and recording terminal that is installed in a parking lot, a gas station, or the like, that print prescribed information on recording paper and issue a resulting sheet, or a ticket reservation and issuance machine for a theater ticket or the like. To print prescribed information such as details of a deal or purchase or ticket reservation information on prescribed paper and issue a resulting sheet, such installation type information terminals incorporate a printing unit that accommodates a roll of recording paper (rolled sheet).

In many cases, such installation type information terminals are installed in a limited business space such as a store. Therefore, they are required to occupy as small an installation area as possible. As a result, printing units that are incorporated in such information terminals are also required to be small and occupy a small installation space. In particular, in convenience stores etc. in which a kiosk terminal is installed, it is important to utilize the floor space effectively. To utilize the floor space effectively, the kiosk terminal is usually installed in front of a wall or a wall face of a goods display stand.

The back side and the right and left sides of the kiosk terminal are also parts of the important floor space, and it is not appropriate to keep these spaces unoccupied as dead spaces for maintenance. In the above circumstances, to perform rolled sheet replacement or maintenance work from the right, left, or back side of the kiosk terminal, it is necessary to move the kiosk terminal or move the goods that are located on the right or left of or behind the kiosk terminal. As a result, even such maintenance work as rolled sheet replacement, which is simple in itself, becomes very complicated. This is not preferable in terms of the store management.

In view of the above, Japanese Patent Publication No. 2002-11917A proposes a printer unit (printing unit) that facilitates maintenance work by exposing components of a printing device to the front side. In this printing unit, rolled sheet replacement and maintenance work can be performed from the front side of an information terminal by tilting a movable frame that is mounted with almost all components, such as a printing section and a rolled sheet container, toward the front side and exposing almost all internal structures of the printing unit to the front side. The workability is thus improved.

However, in the printing unit disclosed in the above publication, a locking mechanism is provided to prevent an unintended movable frame tilting operation. In addition, the locking mechanism and tilting mechanism are of independent functions. Therefore, to access the inside of the printer unit, it is necessary to effect releasing before a tilting manipulation and then expose the inside of the printing unit by tilting the movable frame. Manipulations by both hands are necessary; that is, a releasing manipulation is performed by one hand and a tilting manipulation is performed by the other hand. It is therefore required to replace the rolled sheet after opening the printer unit with both hands, and the efficiency of rolled sheet replacement work is thus low. Further, the configuration that causes exposure of the inside of the printing unit is not appropriate for daily work such as rolled sheet replacement because the inside of the printer unit is subjected to a risk of being damaged by, for example, a drop of goods. It is also desired to increase the efficiency of setting a recording portion of a rolled sheet in a transport path after mounting the rolled sheet.

SUMMARY OF THE INVENTION

It is therefore an object of the invention to provide a printing unit in which a simple structure allows a front portion of the apparatus to be freed for the purpose of rolled sheet replacement or maintenance work and an unlock manipulation and an opening manipulation for freeing the front portion can be performed with one hand.

It is also an object of the invention to provide a printing unit that requires less installation space for rolled sheet replacement and enables increased efficiency for replacing a rolled sheet or the like.

In order to achieve the above objects, according to the invention, there is provided a printing unit, comprising:

a first frame member, having an accommodating section adapted to accommodate a rolled sheet at a rear side of the first frame member;

a print head, operable to perform printing with respect to a print sheet drawn out from the rolled sheet;

a second frame member, supporting the print head and coupled with a front side of the first frame member so as to be movable between a first position and a second position;

a locking mechanism, which locks the second frame member in the first position; and a release lever engageable with the locking mechanism, the release lever releasing the locked state of the second frame member when the release lever is pulled toward the second frame member, wherein at least the accommodating section is accessible when the second frame member is placed in the second position.

With this configuration, after holding the release lever to pivot the second frame member to the second position, an operator can move the release lever toward the second frame member. That is, the operator can access the rolled sheet by pivoting the second frame member to the second position after holding the release lever with one hand and then moving the second frame member without the need for making any other manipulations.

In a case where the second frame member is configured to be moved to the front side of the printing unit, the installation space can be efficiently used.

Preferably, the direction that the release lever is pulled is the same direction as that of the second frame member when the second frame member is moved to the second position.

Here, it is preferable that the release lever has an operating portion arranged between the second frame member and the accommodating section and operable to release the locked state of the second frame member.

With this configuration, the second frame member can be unlocked in a natural manner and be moved to the second position by holding the second frame member while pulling the release member toward the user.

It is further preferable that the second frame member is pivotable between the first position and the second position, and a pivot center of the second frame member is movable when the release lever is pulled.

With this configuration, since the second frame member is lifted when the locked state is released, a moderate load occurs at the time of releasing operation, and the user can clearly recognize the releasing. By virtue of this load, releasing is not effected easily even if a tool or the like hits the release lever accidentally. A stable pivoting operation of the second frame member is thus enabled.

Here, it is preferable that: the first frame member is formed with a projection and the second frame member is formed with a groove shaped to receive the projection to lock the second frame member at the first position; and the projection is disengaged from the groove when the release lever is pulled.

It is further preferable that: the release lever is pivotably provided on the second frame member; and the operating portion of the release lever is brought into contact with the first frame member when the release lever is pulled, so that the pivot center is moved.

It is still further preferable that: the first frame member is formed with a fixed pivot shaft; the second frame member is formed with a slot receiving the fixed pivot shaft; and the operating portion of the release lever is brought into contact with the pivot shaft when the release lever is pulled.

Preferably, the printing unit further comprises: a buffer member disposed between the second frame member and the accommodating section and being movable between a third position and a fourth position; a first urging member engaging the buffer member and urging the buffer member toward the third position, soothe buffer member in the third position being disposed in a sheet path of the rolled sheet such that the print sheet of the rolled sheet is curved by the buffer member; and a linker, which links the release lever and the buffer member such that the buffer member is retracted from the print sheet of the rolled sheet and moved to the fourth position when the release lever is pulled.

With this configuration, the buffer member is caused to escape from the ordinary position in cooperation with movement of the release lever to secure enough space to access the rolled sheet. Further, this structure prevents the buffer member from being damaged when maintenance work is performed.

Here, it is preferable that the linker comprises an elongated flexible member, ends of which are connected to the release lever and the buffer member, respectively.

The use of such a flexible linker makes it possible to link the release lever and the buffer plate to each other easily with a simple structure.

It is further preferable that the linker comprises at least one guide member which routes the elongated flexible member.

With this configuration, the use of the guide member makes it possible to control the operation of the linker such as a wire accurately and reliably. The use of two or more guide members enables a more accurate escape operation of the buffer member.

Alternatively, it is preferable that the buffer member is formed with a hole, and the linker comprises a shaft member fitted into the hole.

It is also preferable that the buffer member comprises an engagement member, and the linker comprises a plate member engaged with the engagement member.

With the above configurations, since the flexible elongated member such as a wire is not used, maintenance for replacement or regular adjustments of the wire or the like as required by expansion or wear of the wire or the like is not necessary. This makes it possible to provide a highly durable escape mechanism.

Preferably, the printing unit further comprises a retainer which engages the buffer member to retain the buffer member at the fourth position when the second frame member is placed in the second position. The retainer is disengaged from the buffer member when the second frame member is moved to the first position.

With this configuration, the user access to the rolled sheet will not be disturbed by the buffer member. After the maintenance work is completed, by returning the second frame member to the first position, the buffer member is also returned to the third position automatically.

Here, it is preferable that the retainer comprises: a hook member provided on the second frame member and movable between a fifth position engaging the buffer member and a sixth position disengaging from the buffer member; a second urging member engaging the hook member and urging the hook member toward the fifth position; and an actuator engaging the hook member and placing the hook member in the fifth position with the aid of the second urging member when the second frame member is placed in the second position, and the actuator placing the hook member in the sixth position against an urging force of the second urging member when the second frame member is placed in the first position.

With this configuration, the retainer retains the buffer member at the fourth position only when the second frame member is located at the second position. Therefore, when the second frame member is returned to the first position, the retainer is unlocked, and the buffer member automatically returns to the third position. This prevents a failure to unlock the retainer.

Here, it is further preferable that: a first end of the actuator is coupled with the hook member and a second end of the actuator is positioned to be brought into contact with the first frame member when the second frame member is placed in the first position; and the second end of the actuator is positioned to disengage from the first frame member when the second frame member is placed in the second position.

With this configuration, a simple structure allows the retainer to operate accurately in cooperation with the pivotal movement of the second frame member.

Here, it is still further preferable that the actuator is a bar-shaped member.

In another exemplary embodiment of the invention, a printer unit comprises:

a base frame member;

a front section pivotably attached to the base frame member, the front section being pivotable between a closed position and an open position;

a print head attached to the front section;

a locking mechanism coupled between the front section and the base frame member, the locking mechanism being operable to lock the front section in the closed position; and a release lever including a pivot axis and a releasing structure that releases the locking mechanism when the release lever is pivoted about the pivot axis.

The release lever comprises a fulcrum positioned to engage one of the base frame member or the front section when the release lever is pivoted about the pivot axis, thereby deflecting the front section and releasing the locking mechanism. Preferably, the front section pivots in a pivot direction from the closed position to the open position, wherein the release lever is pivotable in the pivot direction to release the locking mechanism.

In another exemplary embodiment of the invention, a printing unit for an installation type information terminal, with operative components of the information terminal facing in a forward direction, comprises a rolled paper housing accommodating a rolled paper, a base frame member, a front section pivotably attached to the base frame member, and a print head attached to the front section, wherein the front section is pivotable in the forward direction to thereby enable access to the rolled paper housing.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the present invention will be described below in detail with reference to the accompanying drawings.

Figure 1:
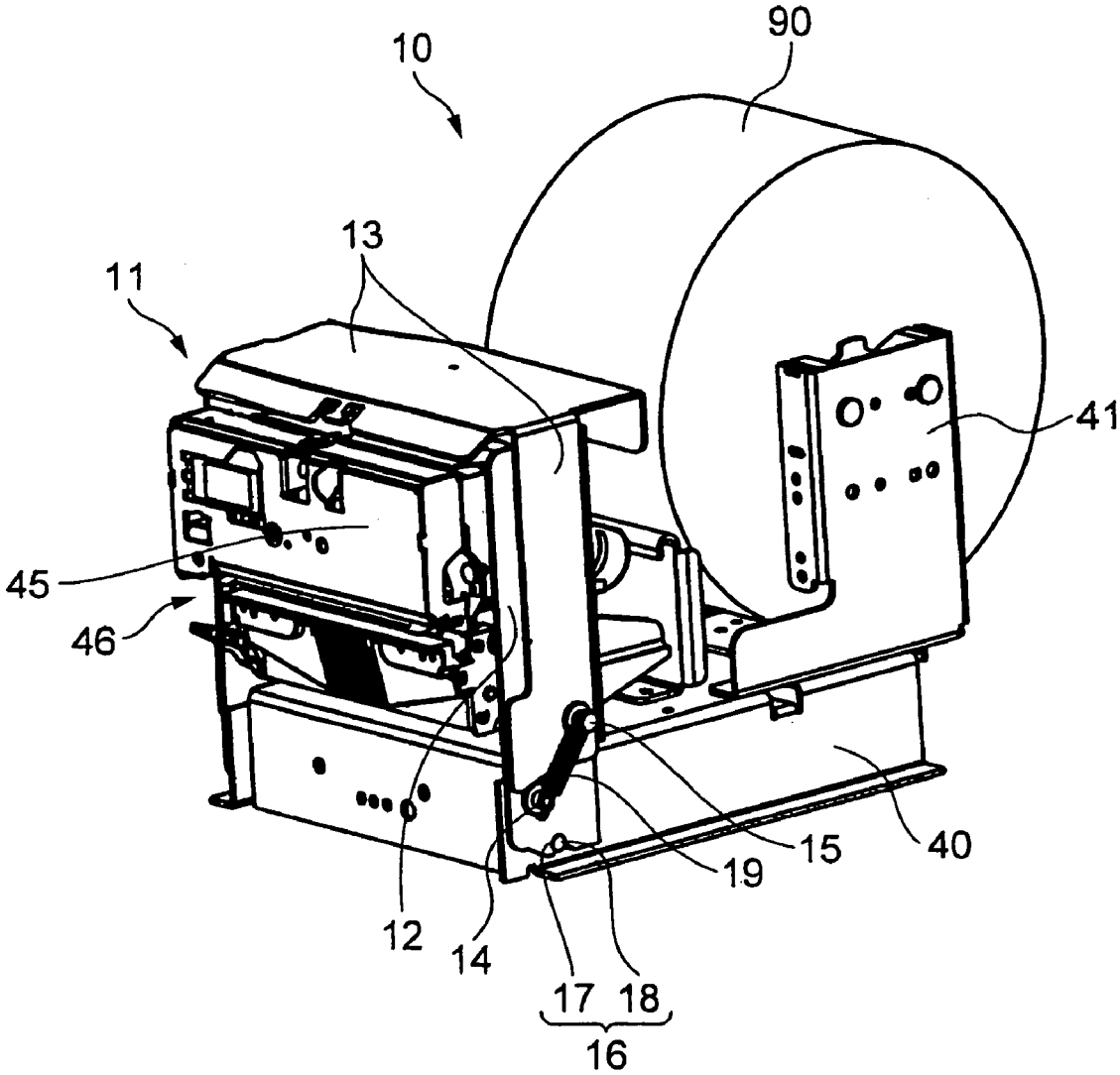
FIG. 1 is a perspective view of a printing unit according to a first embodiment of the invention.

FIG. 1 shows a printing unit 10 according to a first embodiment of the invention. In this embodiment, the printing unit 10 is equipped with a front section 11 that is pivotable outward, a base frame 40, and a rolled sheet holder 41 for holding a rolled sheet 90 inside the printing unit 10. The front section 11 includes a release lever 13 and a movable frame 12 and is lifted up by pulling, to the front side, the release lever 13 that is provided on the front side of the apparatus. As a result, the movable frame 12 is unlocked and can be pivoted forward. Therefore, by pulling the release lever 13 to the front side together with the movable frame 12, the entire front section 11 is tilted forward. Since the movable frame 12 can be unlocked and the front section 11 can be tilted forward merely by such a simple manipulation (pulling the release lever 13 to the front side), the front portion can be easily freed with one hand. Although the front portion can be freed by pulling the release lever 13 to the front side, the movable frame 12 is lifted up when it is unlocked. Since a prescribed load occurs at the time of releasing and the operator's hand should receive a feel specific to it, the movable frame 12 is not unlocked easily, and hence the probability of an erroneous manipulation is low.

The structure of the front section 11 will be described below. The front section 11 is provided with a printing mechanism 45 including a print head (not shown), the movable frame 12 that is pivotally supported by first shafts 14 that are fixed to the base frame 40, and a locking mechanism for locking the movable frame 12 to prevent its pivotal movement.

The printing mechanism 45 is supported by and moves together with the movable frame 12. The locking mechanism is provided with the release lever 13 and a locker 16 comprising notches 17 and pins 18. Pivotally supported by second shafts 15 that are fixed to the movable frame 12, the release lever 13 unlocks the movable frame 12 when pivoted outward. The release lever 13 is urged clockwise as viewed in FIG. 1 (toward the locking side) by elastic members 19 such as helical springs. The details of the locking mechanism, the releasing mechanism, and a pivotal movement mechanism will be described later.

The printing mechanism 45 is equipped with the print head and a platen (both are not shown). These members cooperate with each other to perform a prescribed printing operation on a recording region of the rolled sheet 90. The rolled sheet is ejected from a sheet outlet 46. Printing control and paper feeding control are performed by a printing controller and a transport controller (not shown). The printing control and the paper feeding control are not directly related to the essence of the invention and hence will not be described in detail. However, a transport path of the rolled sheet 90 will be described later.

Figure 2:
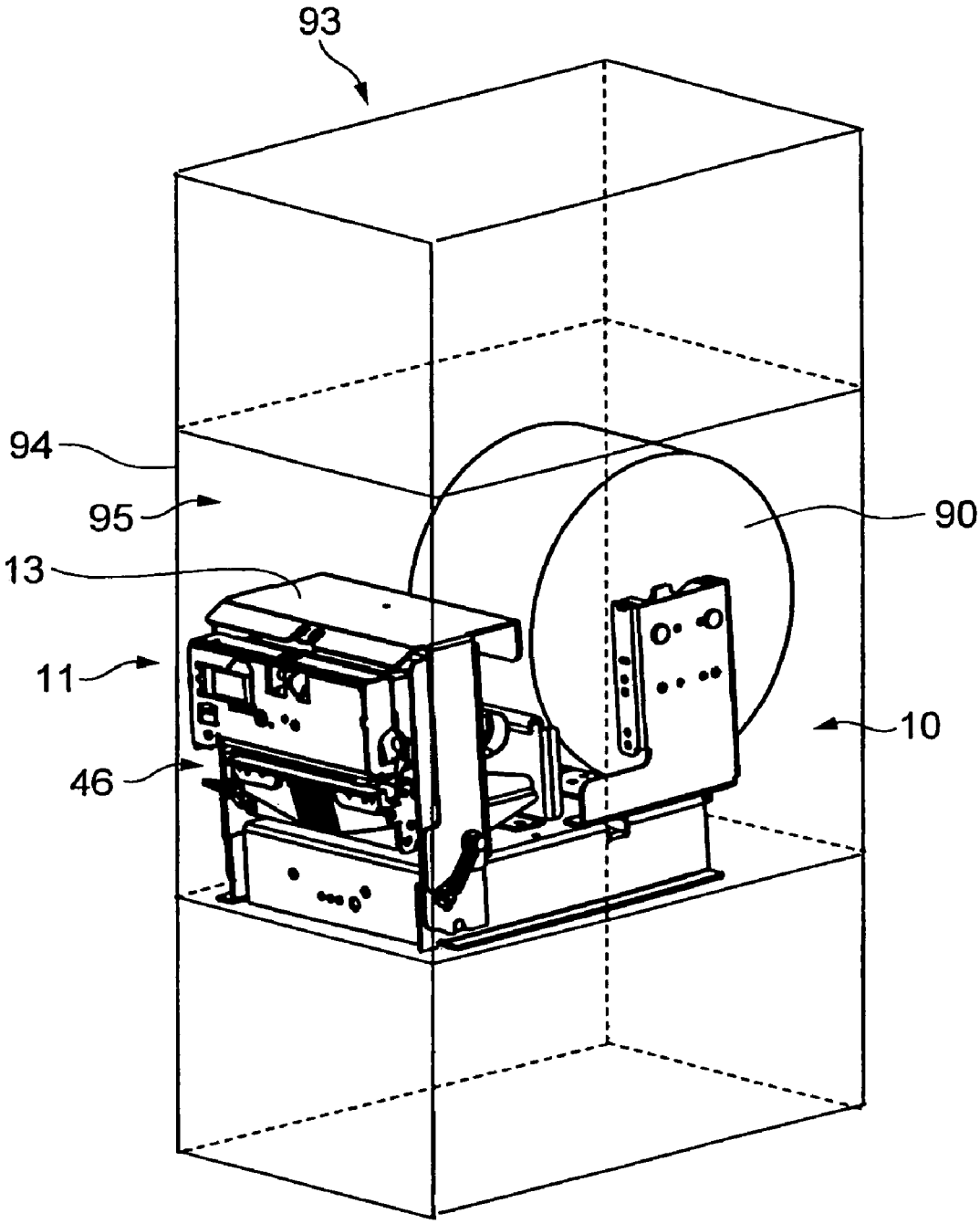
FIG. 2 is a schematic perspective view showing the printing unit of FIG. 1 incorporated in an information terminal.

As shown in FIG. 2, the printing unit 10 is accommodated inside an information terminal 93 such as an ATM or a kiosk terminal (in FIG. 2, an external form of the information terminal 93 is schematically shown by straight lines). Therefore, to replace the rolled sheet 90 or supply a new one, it is necessary to open an outer cover of the information terminal 93 and then access the inside of the printing unit 10.

In this embodiment, a front cover 94 of a middle section of the information terminal 93 is opened, and the release lever 13 is pulled to the front side by inserting one hand through a gap 95. When the release lever 13 is pulled to the front side, the movable frame 12 is unlocked and rendered capable of being tilted to the front side (i.e., outward). Therefore, if the release lever 13 is pulled to the front side and pulling the lever 13 together with the movable frame 12 is continued, the front section 11 is pivoted outward by about 90° about the first shafts 14. When the front section 11 is pivoted outward, the front portion of the printing unit 10 is freed, whereby it becomes possible to replace the rolled sheet 90 from the front side. The inside of the printing mechanism 45 that is fixed to the movable frame 12 is exposed to the outside (front side) of the information terminal 93, which facilitates maintenance of the internal structures such as the print mechanism. In this manner, it becomes possible to easily perform maintenance work, such as attaching the rolled sheet 90 to the holder 41 or the like without the need of moving goods etc. that are placed on both sides of and behind the information terminal 93.

Figure 3:
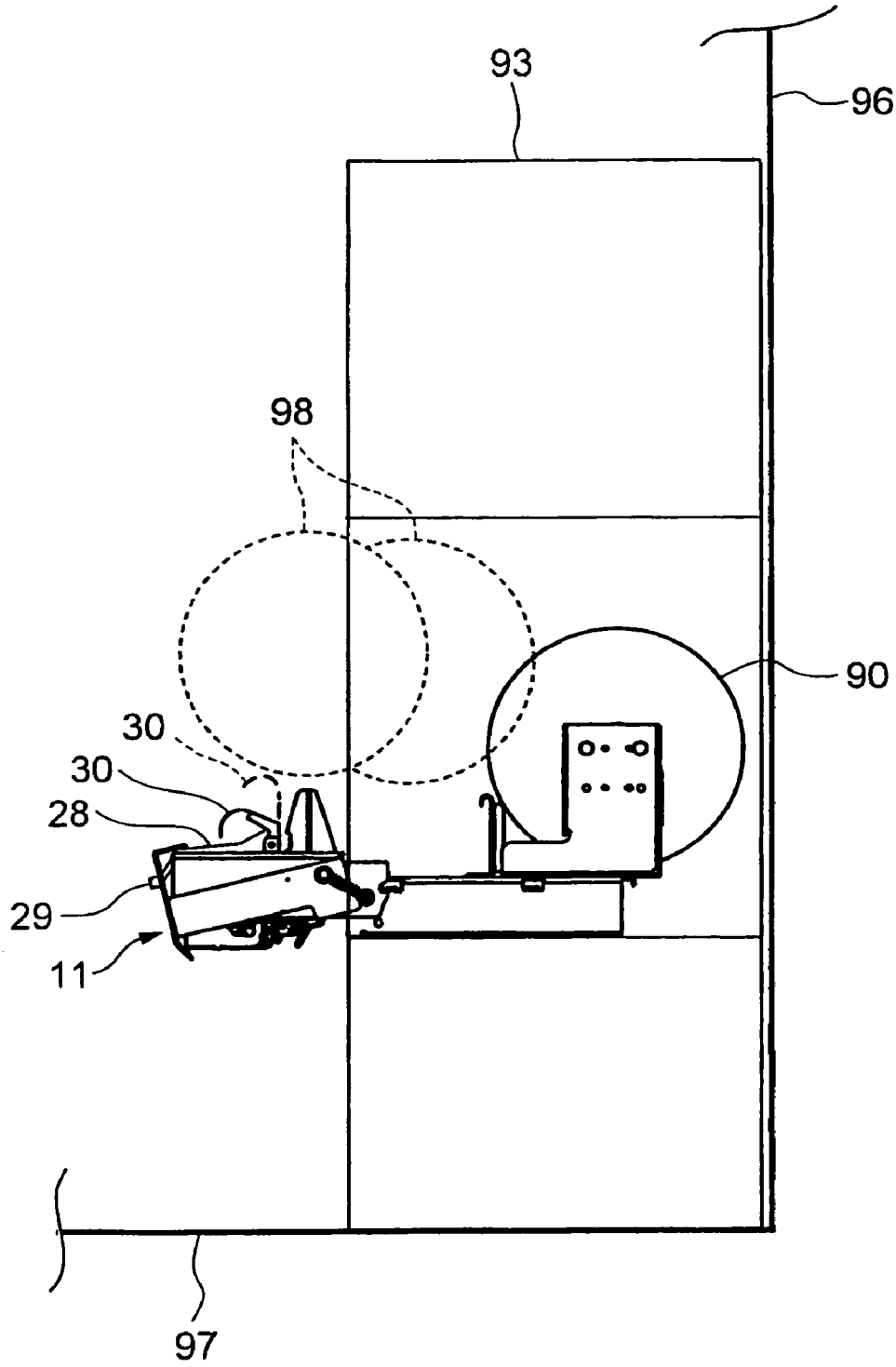
FIG. 3 is a schematic side view showing a front section of the printing unit of FIG. 2 pivoted forward.

FIG. 3 is a schematic side view of the printing unit 10 mounted in the information terminal 93 with the front portion freed by pivoting the front section 11 by about 90°. In many cases, the information terminal 93 such as a kiosk terminal is installed on a floor 97 in front of a wall 96 of a store. Further, a goods display stand or the like is usually placed on both sides of the information terminal 93. However, usually, to enable access to the information terminal 93, no items are placed in front of (the operating face of) the information terminal 93. In view of this, in the invention, the front portion is freed and the printing mechanism 45 is exposed to the outside of the information terminal 93 by pivoting the front section 11 to the front side (outward), which makes it possible to perform maintenance work or rolled sheet 90 replacement from the front side (operating side) of the information terminal 93.

Dashed-line circles 98 indicate an install path (replacement) of a rolled sheet 90. Freeing the front portion in the above-described manner makes it possible to install or replace the rolled sheet 90 easily. It is satisfactory to provide, as the install path for the rolled sheet 90, a space wide enough for part of the rolled sheet 90 to pass through. That is, it is satisfactory to secure, as the install path, a space that is a little wider than the diameter of the rolled sheet 90 used in the printing unit 10. When the front section 11 is not opened, the space to be freed by the above pivotal movement is occupied by the front section 11 including the printing mechanism 45. Therefore, this space is not a dead space. By virtue of the structure with which the printing mechanism 45 of the front portion is pivoted by about 90° in the above-described manner, the printing unit 10 can be downsized and the operation space for an opening operation and the space necessary for maintenance work, installation work for the rolled sheet, and the like can be made very small.

Figure 4A:
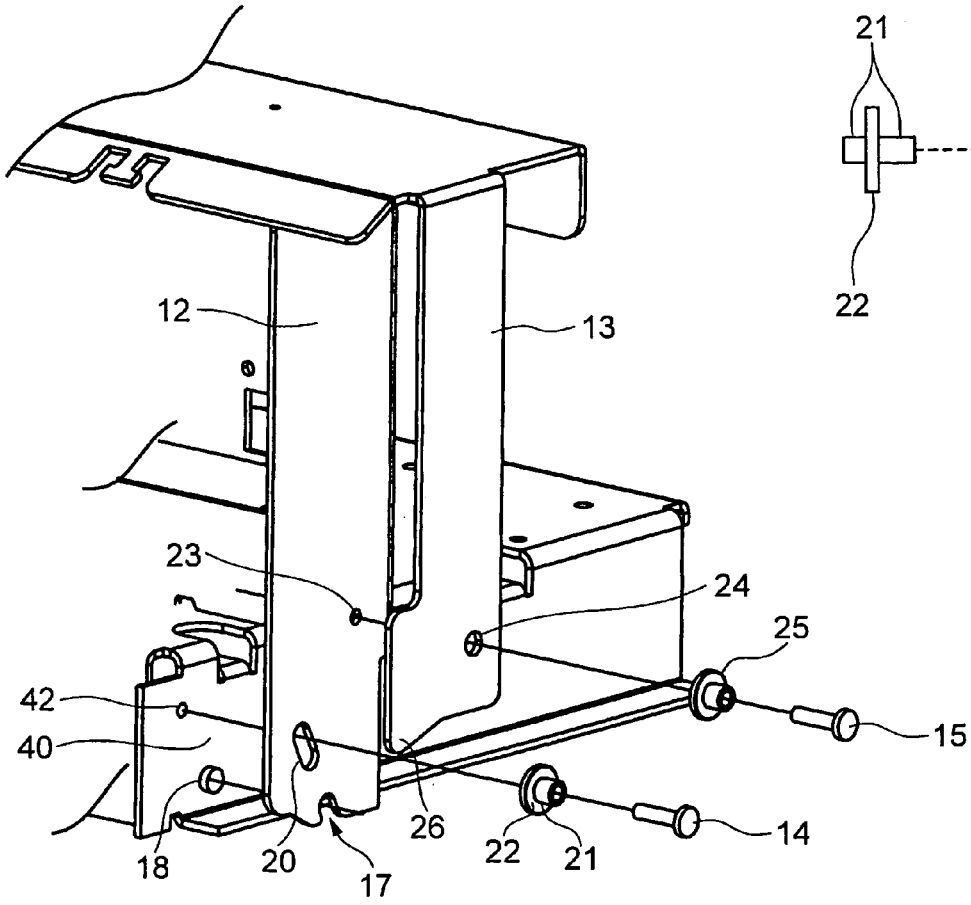
FIG. 4A is an enlarged perspective view showing a disassembled state of a base frame, a movable frame and a release lever in the printing unit of FIG. 1.
Figure 4B:
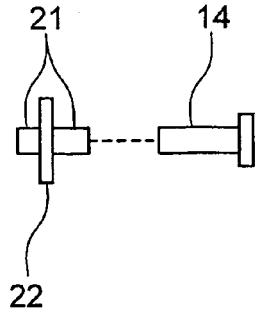
FIG. 4B is an enlarged plan view of a first shaft and a first bearing shown in FIG. 4A.

The structures and operations of the movable frame 12 and the release lever 13 of the printing unit 10 will be described below with reference to FIGS. 4A and 4B. The first shaft 14 is a fixed shaft and a first bearing 21 is a rotary shaft that rotates around the first shaft 14. A slot 20 is formed through the movable frame 12, and the first shaft 14 penetrates through the slot 20 and is fixed to a fixing hole 42 of the base frame 40. The second shaft 15 and a second bearing 25 have the same structure as the first shaft 14 and the first bearing 21.

The first shaft 14 is fixed to the base frame 40 while penetrating through the first bearing 21 and the slot 20. The first bearing 21 includes a flange 22. Therefore, the first shaft 14 and the first bearing 21 constitute a pivotal support member, and the movable frame 12 is pivotable about the first shaft 14. Further, the first shaft 14 penetrates through the slot 20 and hence can slide in the slot 20. Therefore, the movable frame 12 can move obliquely upward or downward along and within the slot 20.

The bottom end portion of the movable frame 12 is formed with the notch 17, and the pin 18 that is fixed to the base frame 40 is inserted in the notch 17. In this state, even if it is attempted to rotate the movable frame 12, the movable frame 12 cannot be pivoted by virtue of the pin 18 engaging the notch 17. That is, the notch 17 and the pin 18 serve as the locker 16 for preventing pivotal movement.

The release lever 13 is pivotably attached to the movable frame 12 with the second shaft 15. The second shaft 15 penetrates through a hole 24 with the second bearing 25 interposed in between, and is fixed to a fixing hole 23 of the movable frame 12. With this structure, the release lever 13 is pivotable about the second shaft 15. The bottom end portion of the release lever 13 is a fulcrum portion 26 for lifting the movable frame 12. When the release lever 13 is pivoted counterclockwise (as viewed in FIG. 4), the fulcrum portion 26 slides on the outer circumference of the flange 22 of the first bearing 21 while maintaining contact with the flange 22. As a result, the fulcrum portion 26 lifts up the front section 11 including the release lever 13 and the movable frame 12.

Figure 5:
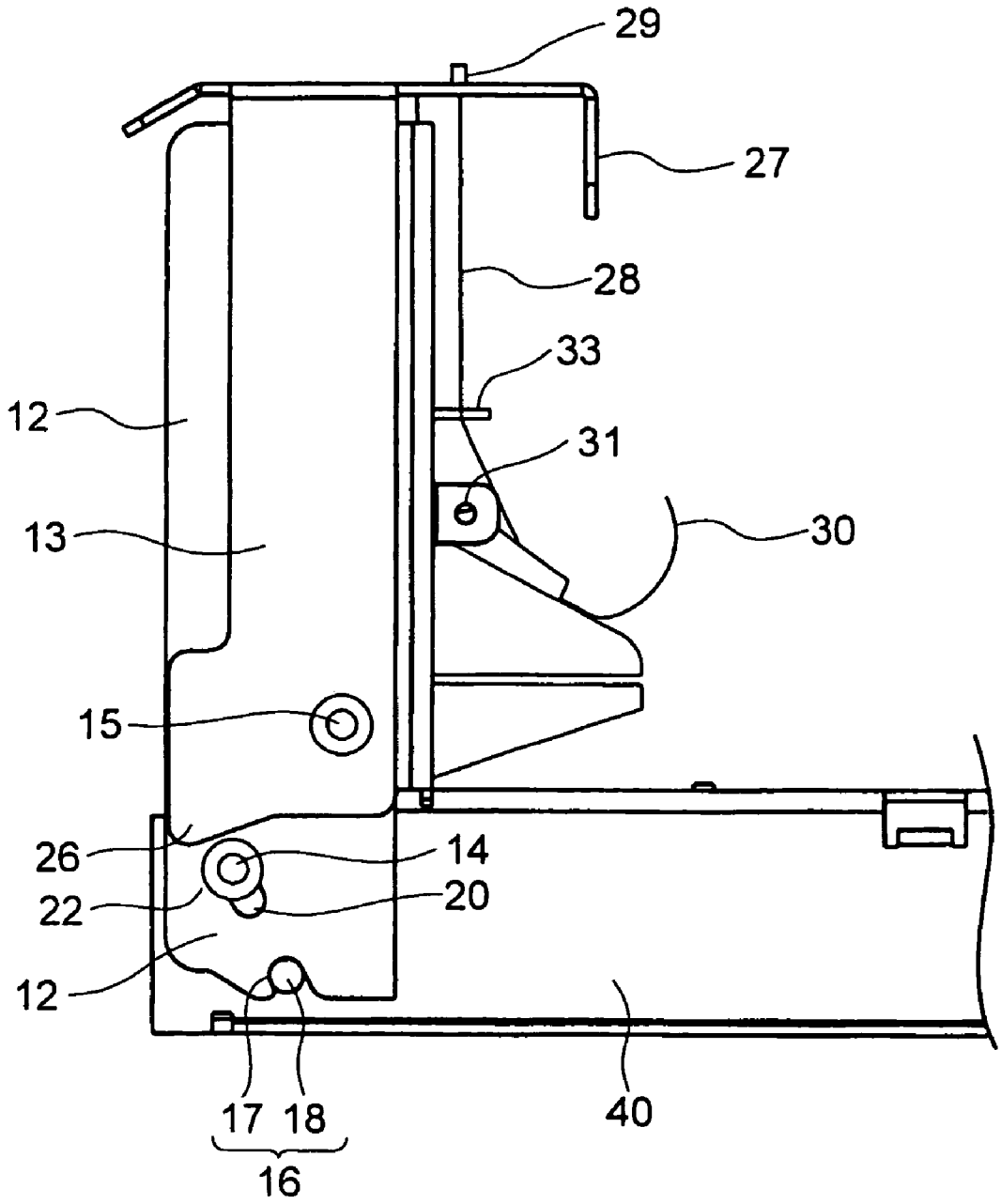
FIG. 5 is an enlarged right side view the front section of the printing unit of FIG. 1 in a locked state.
Figure 6:
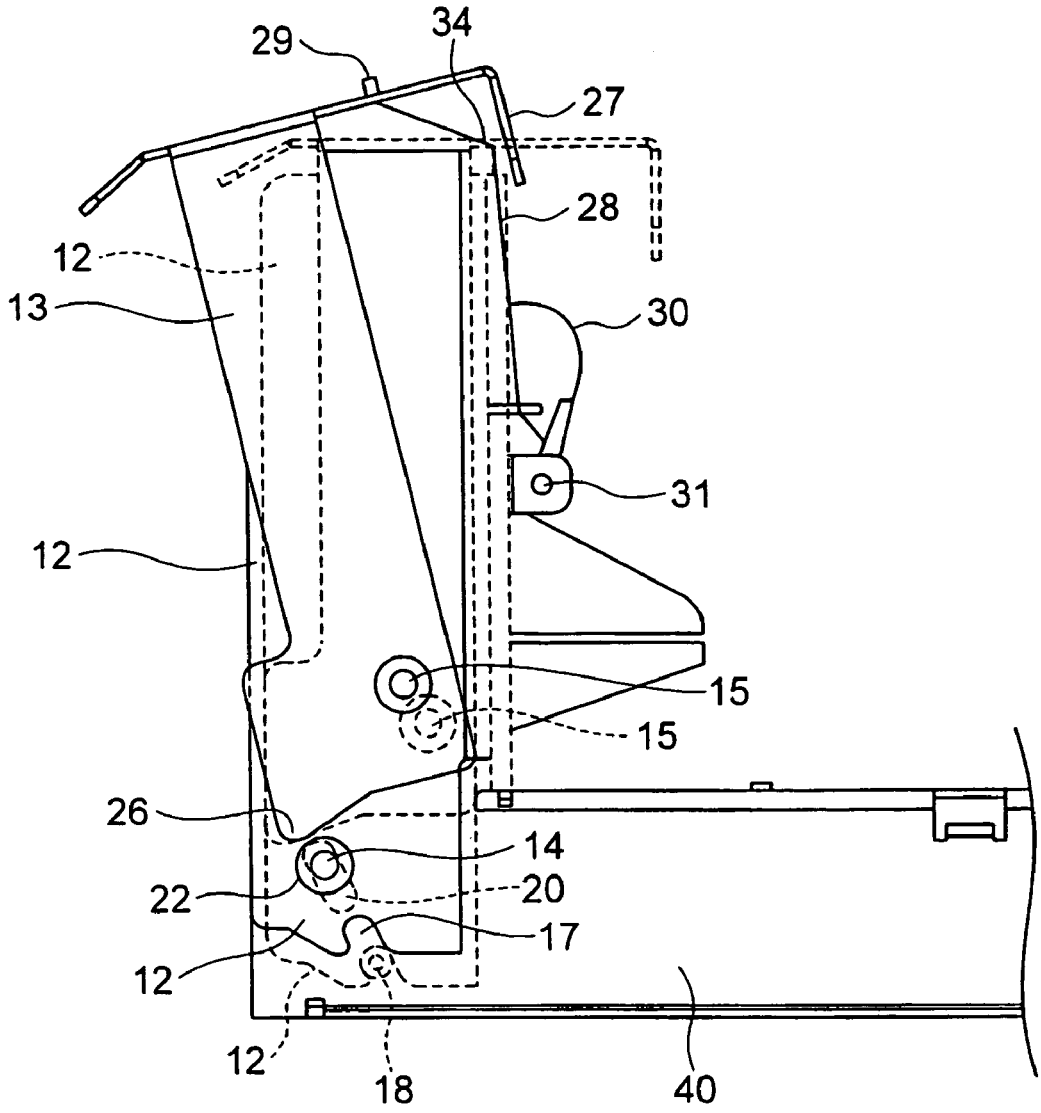
FIG. 6 is an enlarged right side view the front section of the printing unit of FIG. 1 in an unlocked state.

FIG. 5 shows the movable frame 12 in a locked state and the release lever 13. FIG. 6 shows the release lever 13 being pivoted by a prescribed angle from its position of FIG. 5 and the movable frame 12 is thereby unlocked. In FIG. 6, positions of the release lever 13 and the movable frame 12 in the unlocked state are indicated by solid lines and those where releasing has not been effected are indicated by dashed lines. As a releasing manipulation, an operator's hand is inserted through the gap 95 that occupies the top portion of the section where the printing unit 10 is accommodated, and a grip 27 of the release lever 13 is pulled to the front side. When the release lever 13 is pivoted to the position indicated by the solid lines in FIG. 6, the movable frame 12 is lifted so that the notch 17 disengages the pin 18, and the movable frame 12 is thereby unlocked. That is, the locker 16 and the release lever 13 cooperate to serve as a locking mechanism.

The release lever 13 is pivotably supported by the movable frame 12 via the second shaft 15. When it is attempted to rotate the release lever 13 counterclockwise to pull it to the front side, the fulcrum portion 26 at the bottom of the release lever 13 is brought into contact with the outer circumference of the flange 22 of the first shaft 14. Since the first shaft 14 is fixed to the base frame 40, if the release lever 13 is pivoted further, a lifting force is generated on the release lever 13 with the fulcrum portion 26 of the release lever 13 serving as a fulcrum.

Since the release lever 13 is supported by the movable frame 12 via the second shaft 15, the movable frame 12 is also lifted up via the second shaft 15 as the release lever 13 is lifted up. Since the movable frame 12 is supported by the first shaft 14 via the slot 20, the movable frame 12 is lifted up along the slot 20. The movable frame 12 is lifted obliquely upward along the slot 20 by more than a prescribed length, and the notch 17 of the locker 16 disengages the pin 18 as indicated by the solid lines in FIG. 6. As a result, the movable frame 12 is unlocked and allowed to rotate about the first shaft 14. Since the release lever 13 and the printing mechanism 45 are attached to the movable frame 12, the entire front section 11 is pivoted outward and the front portion of the printing unit 10 is freed by pivoting the movable frame 12.

Figure 7:
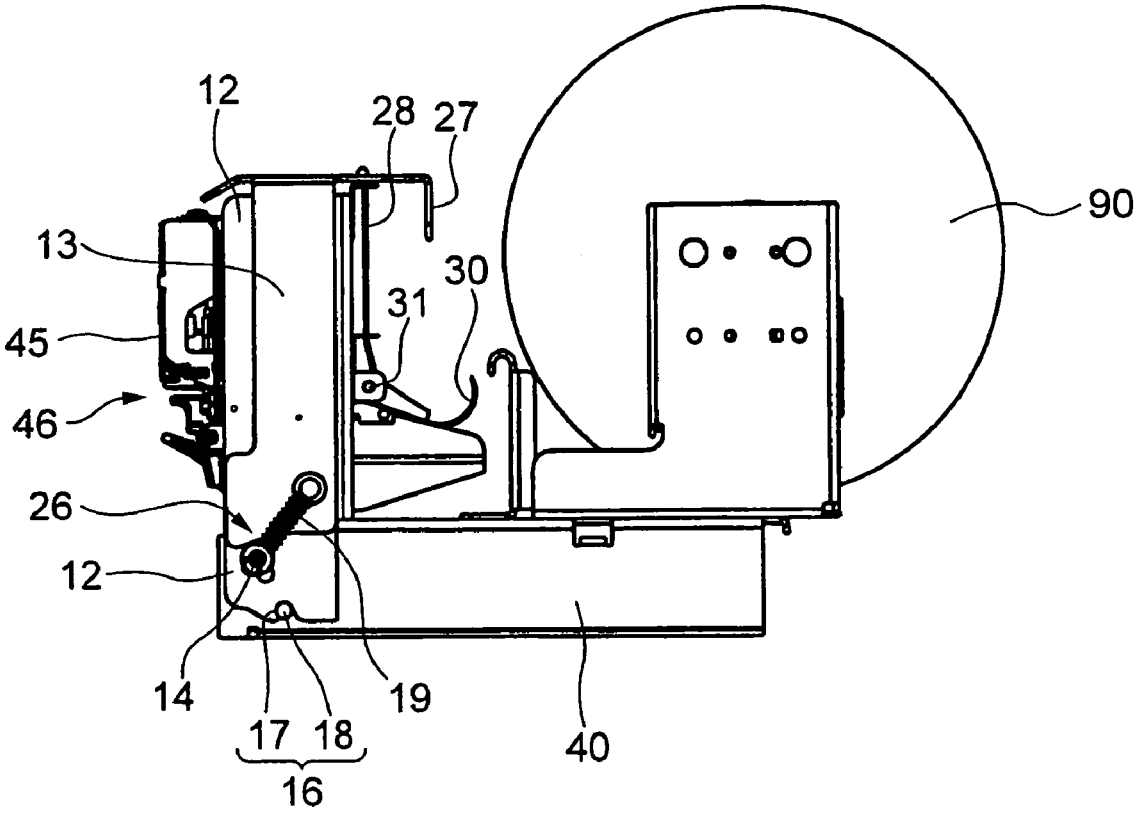
FIG. 7 is a right side view the printing unit of FIG. 1 in the locked state.
Figure 8:
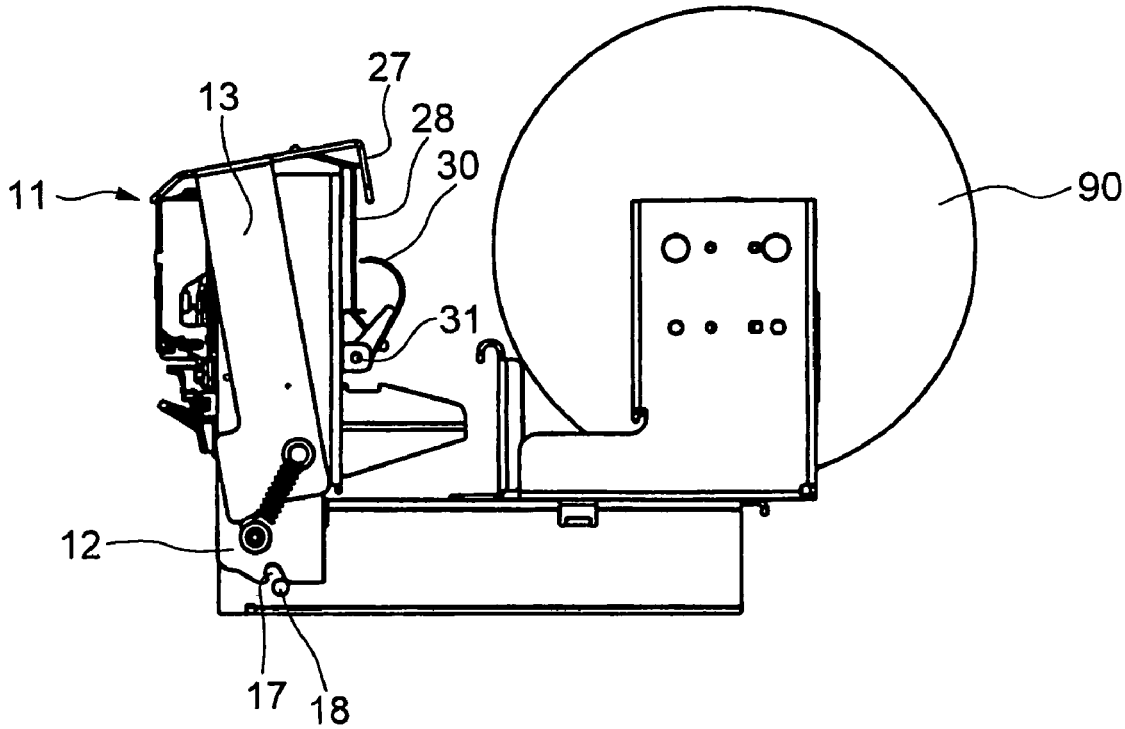
FIG. 8 is a right side view the printing unit of FIG. 1 in the unlocked state.
Figure 9:
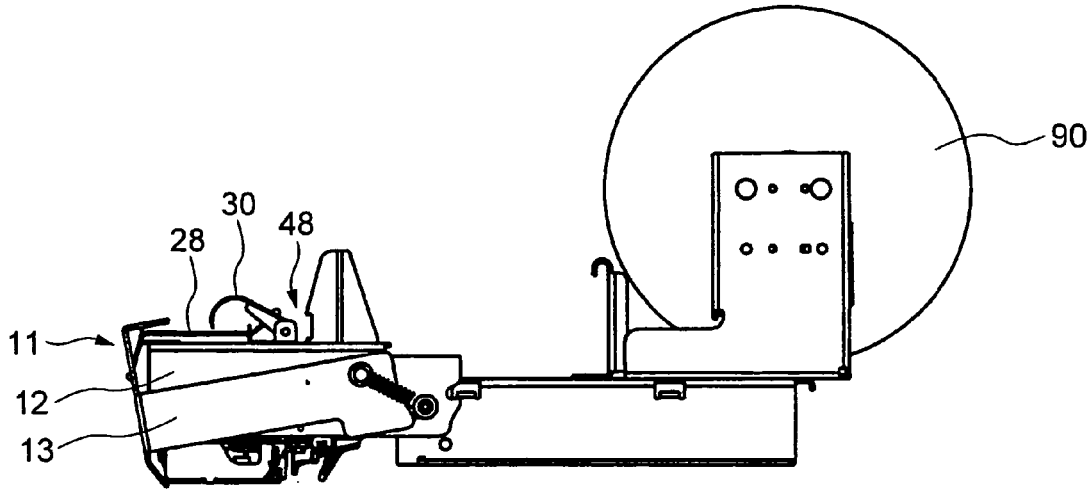
FIG. 9 is a right side view of the printing unit of FIG. 1 showing the front section completely pivoted forward.
Figure 10:
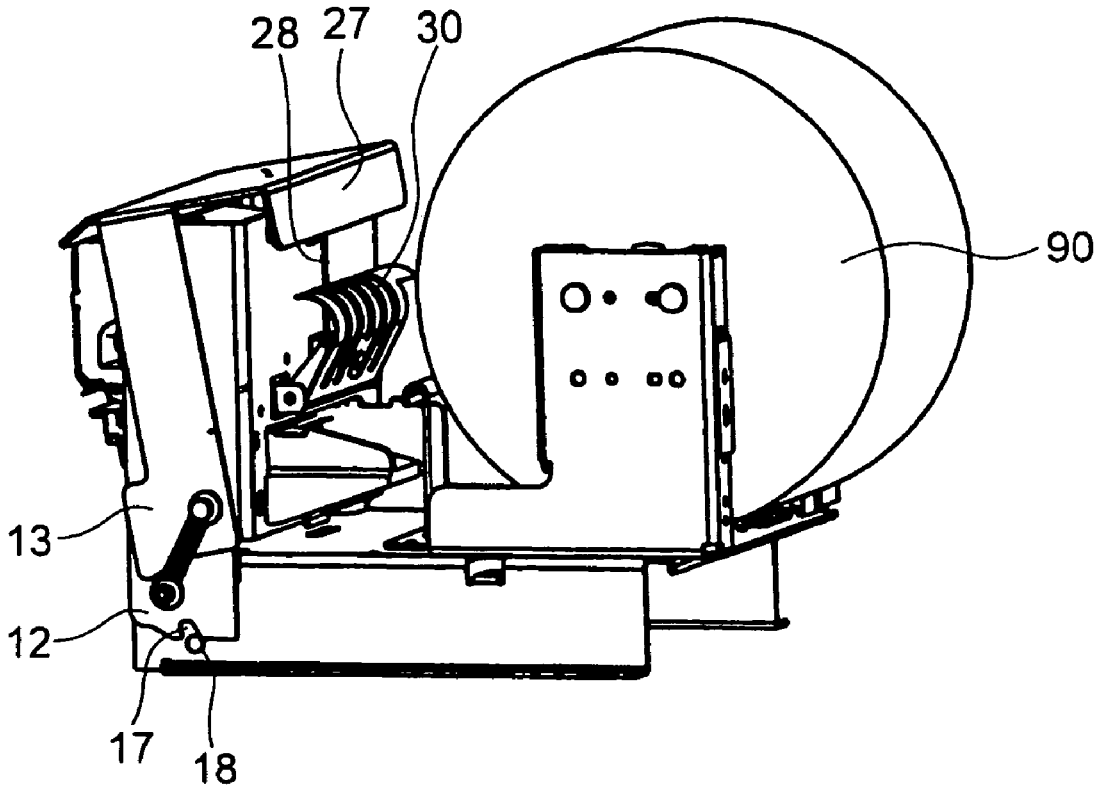
FIG. 10 is a perspective view of the printing unit in FIG. 8 viewed from the rear side.
Figure 11:
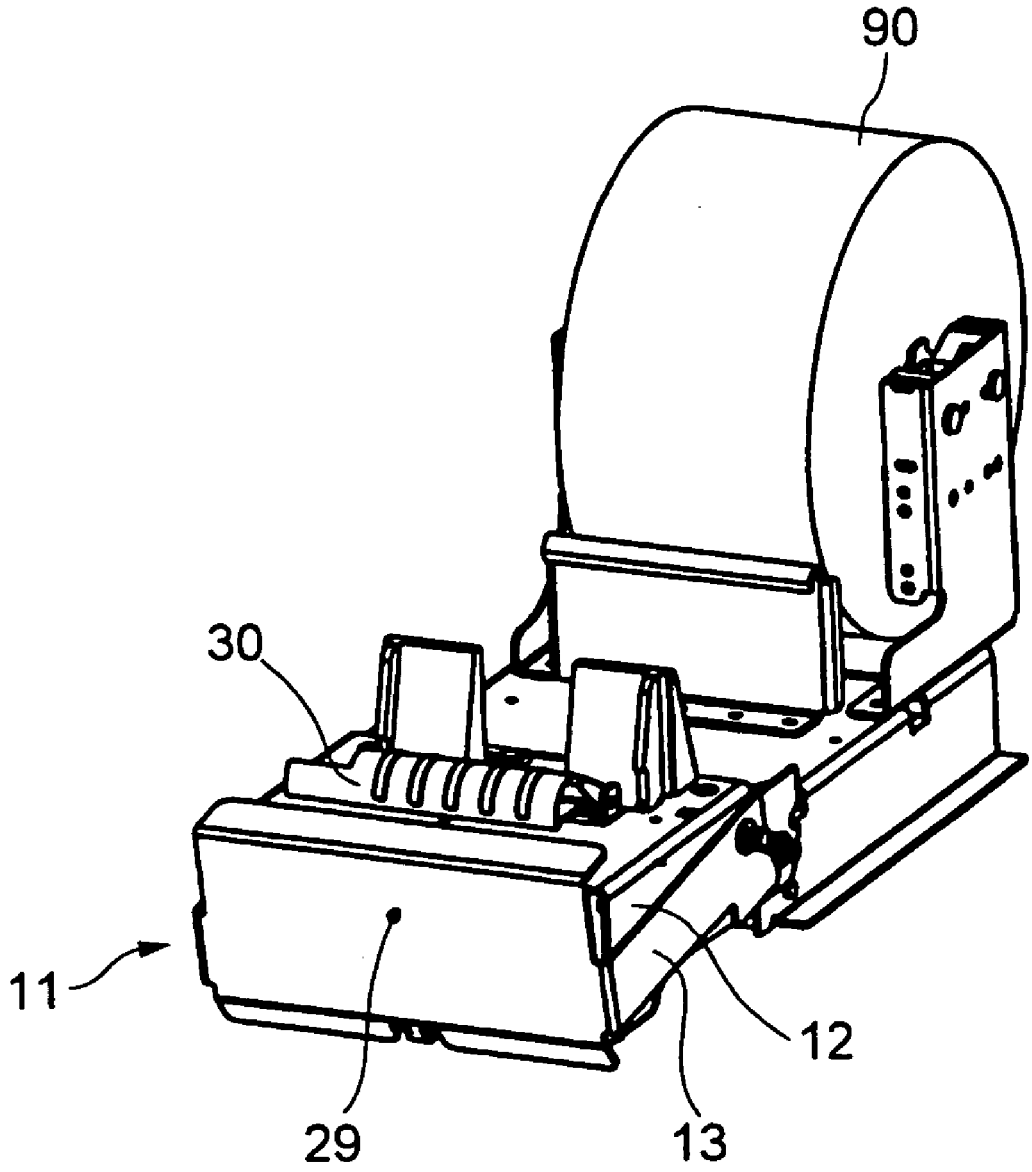
FIG. 11 is a perspective view of the printing unit in FIG. 9 viewed from the front side.

FIGS. 7 to 9 show a series of operations that are performed from when the movable frame 12 is locked to when the movable frame 12 is unlocked and the front section 11 is pivoted counterclockwise by about 90°. FIGS. 10 and 11 are left side views corresponding to FIGS. 8 and 9, respectively.

FIG. 7 shows a state where the printing unit 10 is accommodated in the information terminal 93 and a printing operation can be performed. In this state, the pin 18 is inserted in the notch 17 of the locker 16 so that the movable frame 12 is locked (i.e., cannot be pivoted). When the grip 25 of the release lever 13 is pulled to the front side from the state of FIG. 7 and the release lever 13 is pivoted to the state of FIG. 8 (see also FIG. 10), the release lever 13 and the movable frame 12 are lifted obliquely upward by the fulcrum portion 26. As a result, as shown in FIG. 8, the notch 17 of the locker 16 disengages from the pin 18, whereby the movable frame 12 may be pivoted counterclockwise (i.e., it is unlocked).

Since the release lever 13 and the printing mechanism 45 are supported by the movable frame 12, these members are pivoted together with the movable frame 12. Therefore, by continuing to pivot the movable frame 12 until the pivotal movement angle becomes about 90°, the entire front section 11 is pivoted as shown in FIG. 9 (see also FIG. 11). As a result, replacement of the rolled sheet 90 and maintenance or repair of the printing mechanism 45 are enabled. In FIGS. 7 to 9, a curved member extending rearward from the printing mechanism 45 is a buffer plate 30 for paper feeding. Urged by an elastic member so as to be located at the position shown in FIG. 7, the buffer plate 30 gives redundancy to the path of a recording portion of the rolled sheet 90 (described later in detail).

As is understood from the above description, according to this embodiment, the movable frame 12 is unlocked by pivoting the release lever 13 in the same direction as the pivot direction of the movable frame 12. The front portion of the printing unit 10 can be freed by continuing to pivot the release lever 13 and the movable frame 12 in the same direction. Therefore, the simple structure makes it possible to free the front portion with one hand and to replace the rolled sheet 90 from the front side of the printing unit 10 with the other hand.

In the configuration of the above example, the movable frame 12 is unlocked by lifting it up by pulling the release lever 13 to the front side. With this configuration, to unlock the movable frame 12, a load for lifting up the weight of the entire movable frame 12 is required. To restore the original state, the movable frame 12 is locked reliably by its own weight. This provides an advantage that inadvertent releasing and a failure to lock the movable frame 12 can be prevented.

Figure 12:
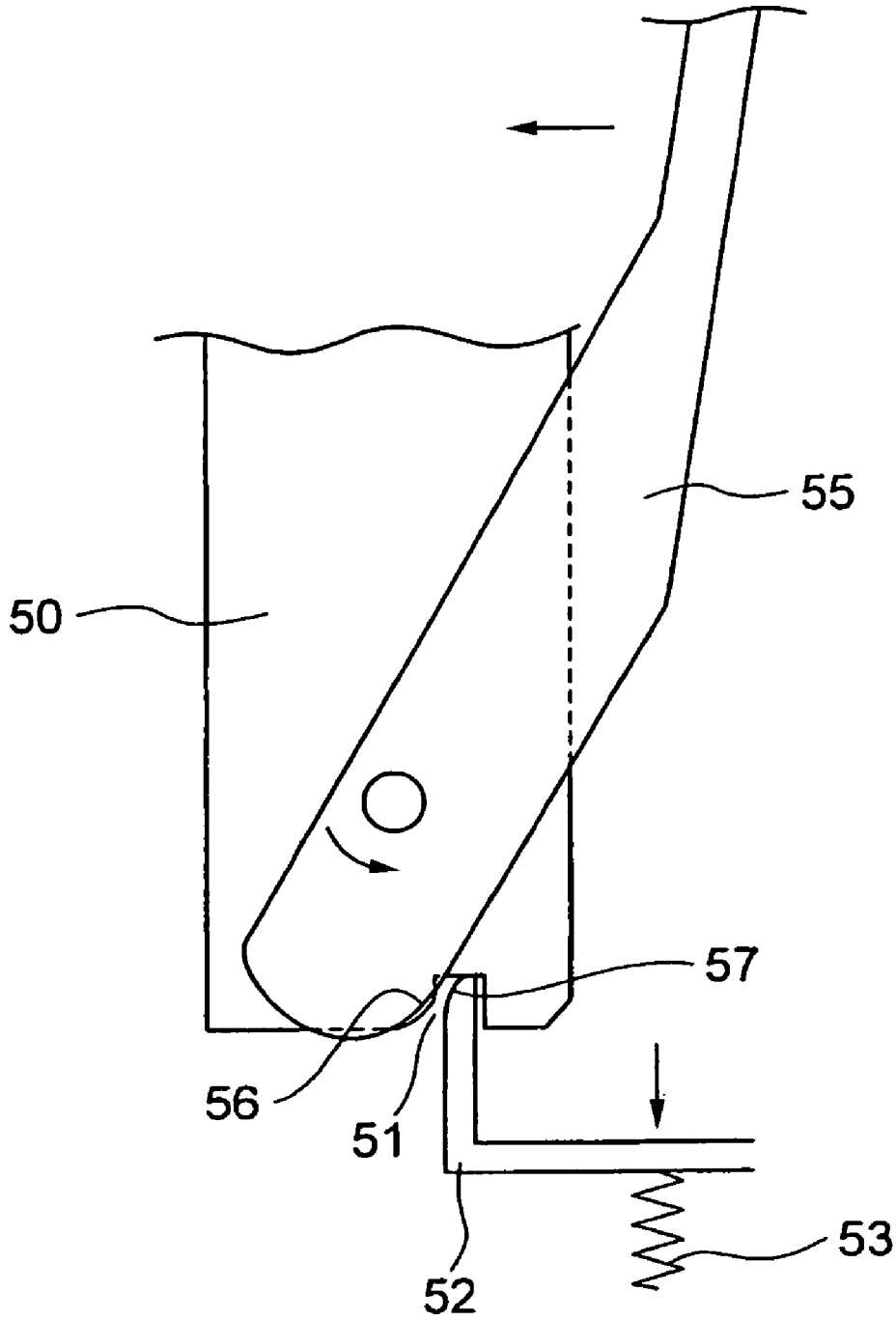
FIG. 12 is an enlarged side view of a modified example of a locking mechanism in the printing unit of FIG. 1.

The invention is not limited to the employment of such a locking/releasing mechanism. FIG. 12 shows another example of the locking mechanism. The bottom portion of a movable frame 50 is formed with a groove 51. The movable frame 50 is locked when the lock member 52 is engaged with the groove 51 and is unlocked when the lock member 52 is disengaged from the groove 51. The lock member 52 is urged toward the groove 51 by an elastic member 53 such as a compression spring. The lock member 52 has an engagement end 57 extending toward the side face of the movable frame 50. The movable frame 50 and a release lever 55 are pivotally supported by the base frame 40 with a rotary shaft 54. The tip portion of the release lever 55 is shaped like a cam and its cam face 56 engages the end 57 of the lock member 52. When the release lever 55 is pivoted toward the movable frame 50 (i.e., counterclockwise), the lock member 52 is pushed down by the cam face 56, and the movable frame 50 is unlocked.

This embodiment is suited for when both of the movable frame 12 or 50 and the release lever 13 or 55 are pivotally supported. However, a portion corresponding to the movable frame 12 or 50 may be tilted forward by a hinge structure. Further, the release member 55 may move the lock member 52 by a link member.

Next, an escape mechanism of the buffer plate 30 will be described. The buffer plate 30 provides redundancy to transport of a recording portion of the rolled sheet 90 to suppress an initial load that occurs in drawing out a portion of the rolled sheet 90 subjected to recording.

Figure 13:
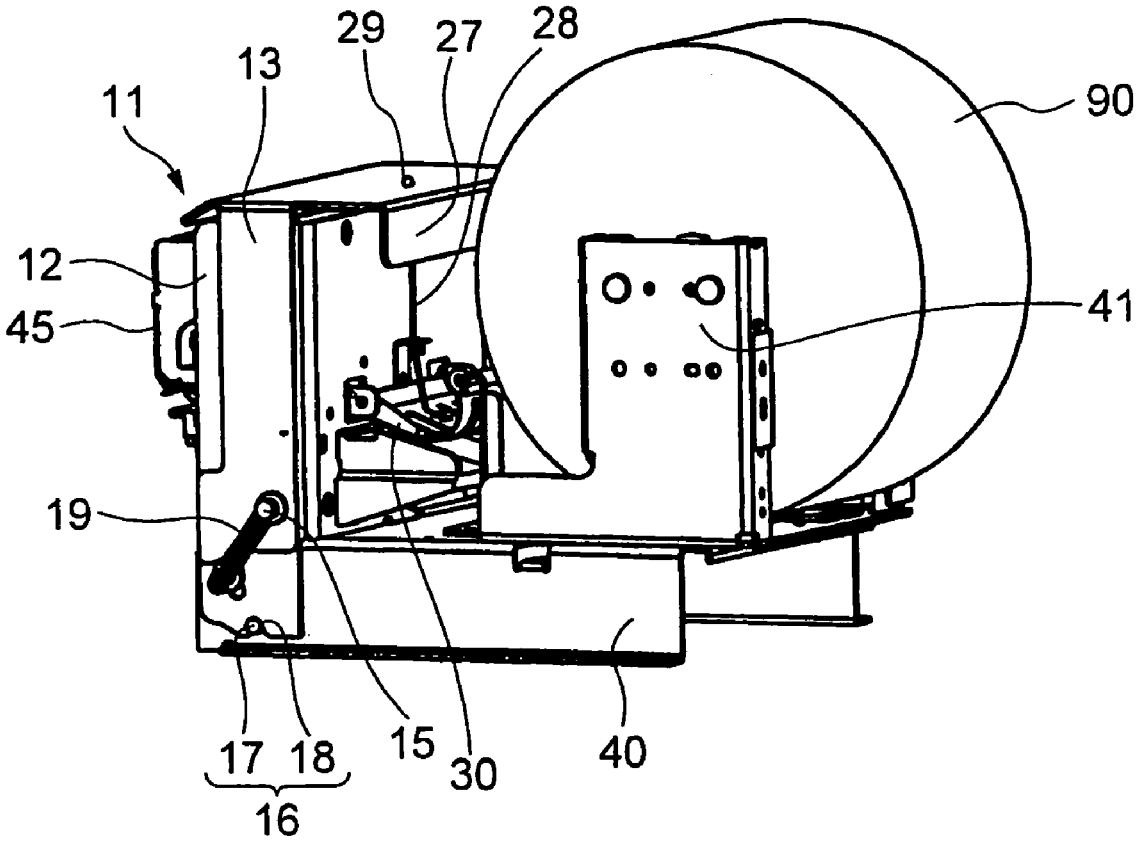
FIG. 13 is a perspective view of the printing unit in FIG. 7 viewed from the rear side.

As shown in FIG. 13, the buffer plate 30 is disposed under the grip 27 of the release lever 13. The buffer plate 30 is pivotally supported by a pivot shaft 31 that is fixed to the movable frame 12 (see FIG. 5), and is urged by an elastic member in a clockwise direction in FIG. 5. In this manner, the buffer plate 30 provides redundancy to the transport path of a portion drawn from the rolled sheet 90. When the portion is abruptly drawn into the printing mechanism 45 via the buffer plate 30, the buffer plate 30 is shifted in the sheet feeding direction and thereby accommodates such an abrupt transport of the leading end portion. By virtue of its redundancy, the buffer plate 30 prevents abrupt application of a load to a transport roller at a start of the sheet feeding and thereby enables accurate transport of the leading end portion and correct printing.

However, the buffer plate 30 projects in the horizontal direction. Therefore, if the front portion is freed by tilting the front section 11 forward with the buffer plate 30 kept as it is, the buffer plate 30 stands vertically (indicated by dashed lines in FIG. 3) and obstructs installation or replacement of the rolled sheet 90 or may even be damaged (indicated by dashed-line circles 98).

In view of the above, in this embodiment, the buffer plate 30 is caused to escape upward in synchronism with a pivotal movement as indicated by the solid line in FIG. 3.

Since the buffer plate 30 escapes in this manner, when the front section 11 is tilted as shown in FIG. 3, the buffer plate 30 does not obstruct installation of a new rolled sheet 90 (indicated by the circles 98), which enables smooth replacement of the rolled sheet 90 and prevents the buffer plate 30 from being damaged. Further, it becomes possible to reduce the work space for rolled sheet replacement or the like.

Figure 14:
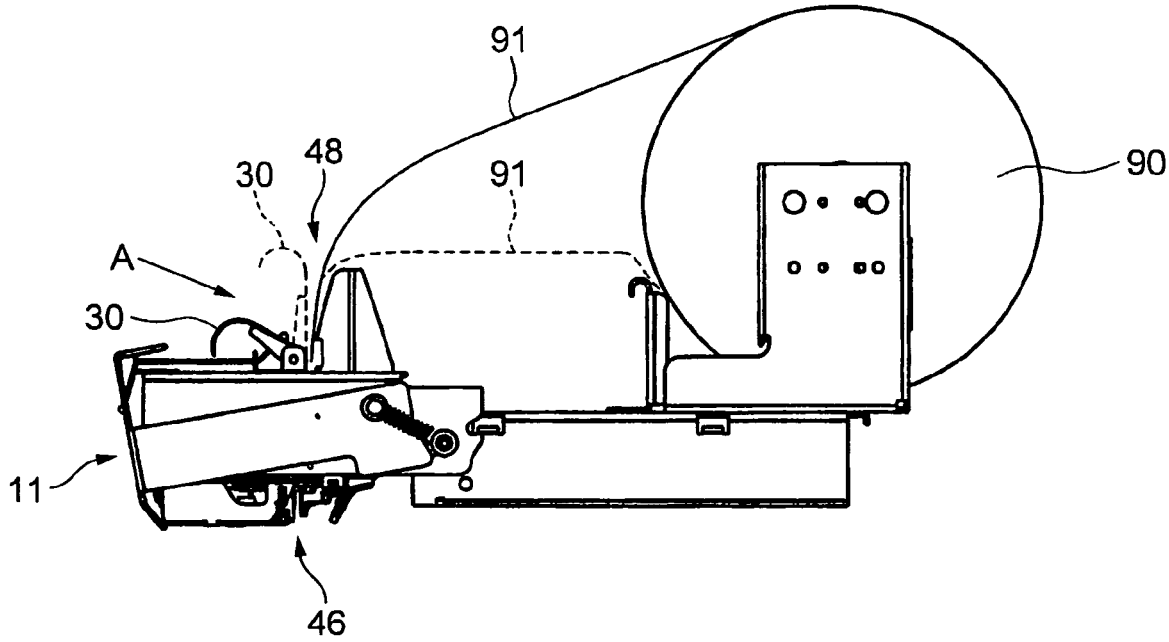
FIG. 14 is a schematic side view for explaining how to perform initial placement of a leading end drawn out from a rolled sheet installed in the printing unit of FIG. 1.

Still further, the escape of the buffer plate 30 facilitates initial placement of the leading end of the rolled sheet 90. Usually, the leading end portion 91 is set along a path indicated by a solid line in FIG. 14. However, the leading end portion 91 may be set along a path indicated by a dashed line. Whether the leading end portion 91 is set along the solid-line path or the dashed-line path is determined depending on which portion of the rolled sheet 90 is located above.

The leading end portion 91 drawn from the rolled sheet 90 is inserted through an sheet inlet 48 that is provided below (in FIG. 4, on the right on the buffer plate 30 and is then output from the sheet outlet 46. An operator who is going to replace the rolled sheet 90 and set a leading end portion 91 needs to set the leading end portion 91 along the prescribed passage from a direction indicated by arrow A. However, if the buffer plate 30 has not escaped and hence is located at the position indicated by the broken line, the operator cannot see the sheet inlet 48 and is forced to insert the leading end portion 91 by groping for the sheet inlet 48. In contrast, where the buffer plate 30 has escaped to the position indicated by the solid line, the operator can recognize the sheet inlet 48 visually and can easily set the leading end portion 91.

The structure of the escape mechanism of the buffer plate 30 will be described below in detail by referring again to FIGS. 5 and 6. As shown in FIG. 5, one end of a wire 28 is fixed to a fixing portion 29 of the release lever 13 and the other end is attached to the buffer plate 30. The wire 28 is attached to the buffer plate 30 via a guide member 33 that is disposed near the buffer plate 30. Therefore, if the release lever 13 is pivoted toward the releasing direction, the wire 28 is pulled up. The buffer plate 30 is pivotably supported by the pivot shaft 31 and is urged by an elastic member (not shown). If the release lever 13 is pivoted and moved toward the releasing position, the wire 28 is pulled up, and the buffer plate 30 is pulled toward the wire guide 33. In this manner, the buffer plate 30 is moved (caused to escape) to the position shown in FIG. 6. It is preferable that a bender 34 (see FIG. 6) where the wire 28 contacts the movable frame 12 is shaped so as to reduce sliding friction or is made of a material capable of reducing friction. Alternatively, a roller or the like may be provided to prevent sliding friction.

Since the release lever 13 and the printing mechanism 45 are attached to the movable frame 12, the entire front section 11 is pivoted outward as the movable frame 12 is unlocked and pivoted forward by about 90°, whereby the front portion of the printing unit 10 is freed. During this operation, since the buffer plate 30 has escaped to the position shown in FIG. 6, the buffer plate 30 does not obstruct installation of a rolled sheet 90, and there is no risk that the buffer plate 30 is damaged. Operation of the buffer plate 30 can be understood by referring to FIGS. 7 to 9.

Although in this embodiment the wire 28 is employed for causing the buffer plate 30 to escape, the wire 28 may be either a metal wire or an artificial fiber wire made of a synthetic resin or the like and may be a single wire or a stranded wire. A band-shaped (sheet-shaped) wire having a certain width can be used instead of the string-shaped wire 28. It is possible to provide plural guide members to guide the wire 28 properly. To enable a smooth pulling operation and return operation, any of various conventional techniques for reducing sliding friction on the guide member (e.g., use of a roller and use of a special material or member capable of enhancing slidability) can be employed.

Figure 15:
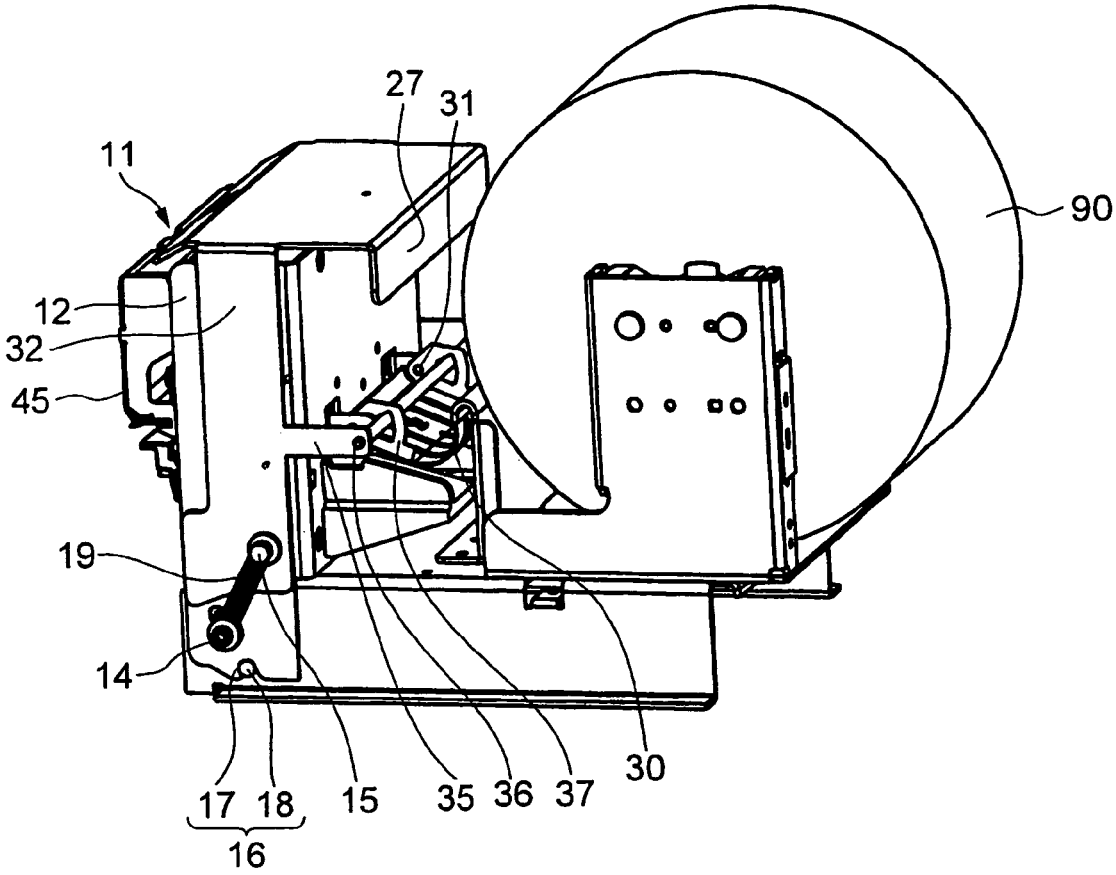
FIG. 15 is a perspective view of a printing unit according to a second embodiment of the invention, showing a locked state of a front section thereof.
Figure 16:
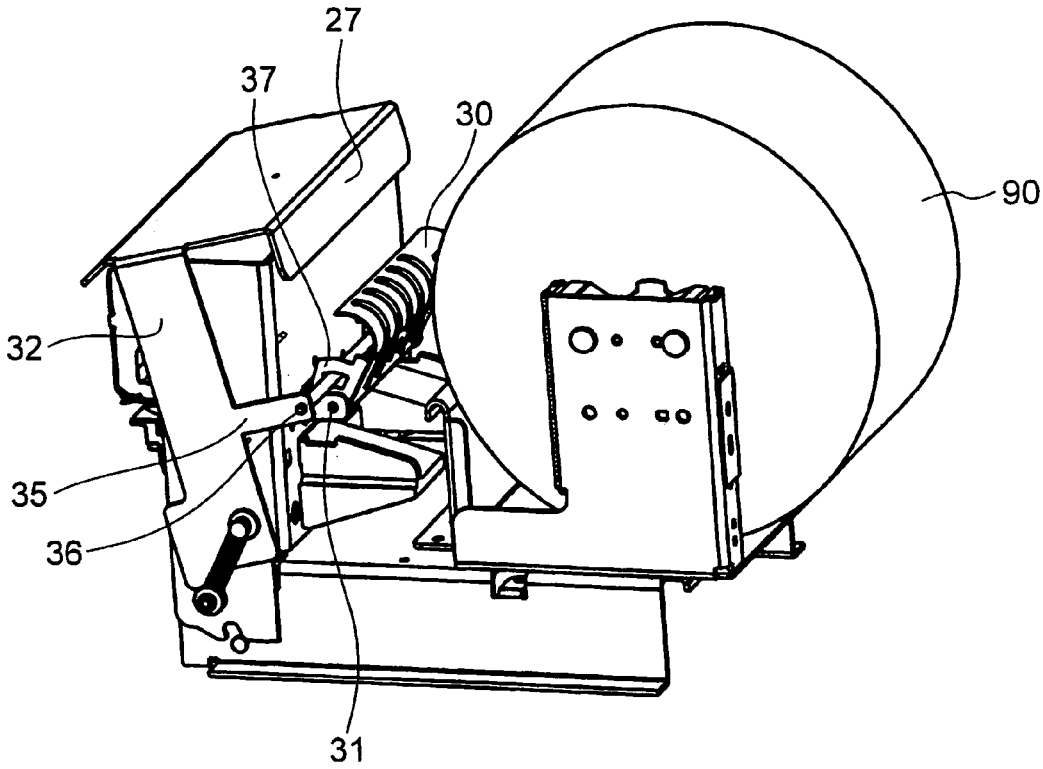
FIG. 16 is a perspective view of the printing unit of FIG. 15, showing an unlocked state of the front section.

FIGS. 15 and 16 show a printing unit according to a second embodiment of the invention. This printing unit is different from the printing unit 10 of FIGS. 1 to 14 in the release lever 32 and the buffer plate 30 escape mechanism. In this embodiment, the release lever 32 is provided with projections 35, and an actuator shaft 36 extending parallel with the buffer plate 30 is attached to the tip portions of the projections 35. The buffer plate 30 is provided with, on both sides, a link portion 37 having a hole. The actuator shaft 36 is attached to the release lever 32 in a state that it penetrates through the holes of the link portions 37. Therefore, the release lever 32 is connected to the buffer plate 30 via the link portion 37, and the projections 35, the actuator shaft 36, and the link portions 37 constitute a link mechanism. When the release lever 32 is pivoted counterclockwise, the actuator shaft 36 rotates counterclockwise about the second shafts 15 which are the pivot centers of the release lever 32 and lifts the buffer plate 30 obliquely upward. Since the buffer plate 30 is pivotally supported by the pivot shaft 31, which is fixed to the movable frame 12, the buffer plate 30 pivots counterclockwise about the pivot shaft 31, that is, moves (escapes) toward the movable frame 12.

Where a wire is used, the wire needs to be replaced or adjusted on a regular basis because of its expansion, wear, etc. The use of the link mechanism dispenses with such maintenance.

Figure 17:
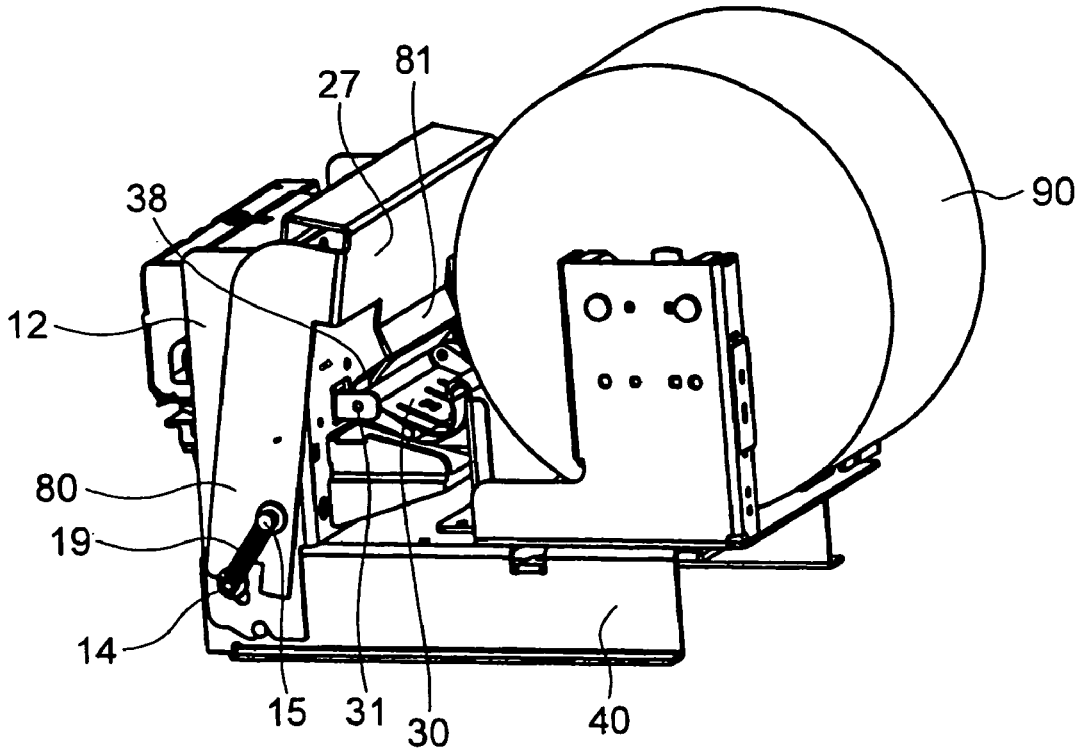
FIG. 17 is a perspective view of a printing unit according to a third embodiment of the invention, showing a locked state of a front section thereof.
Figure 18:
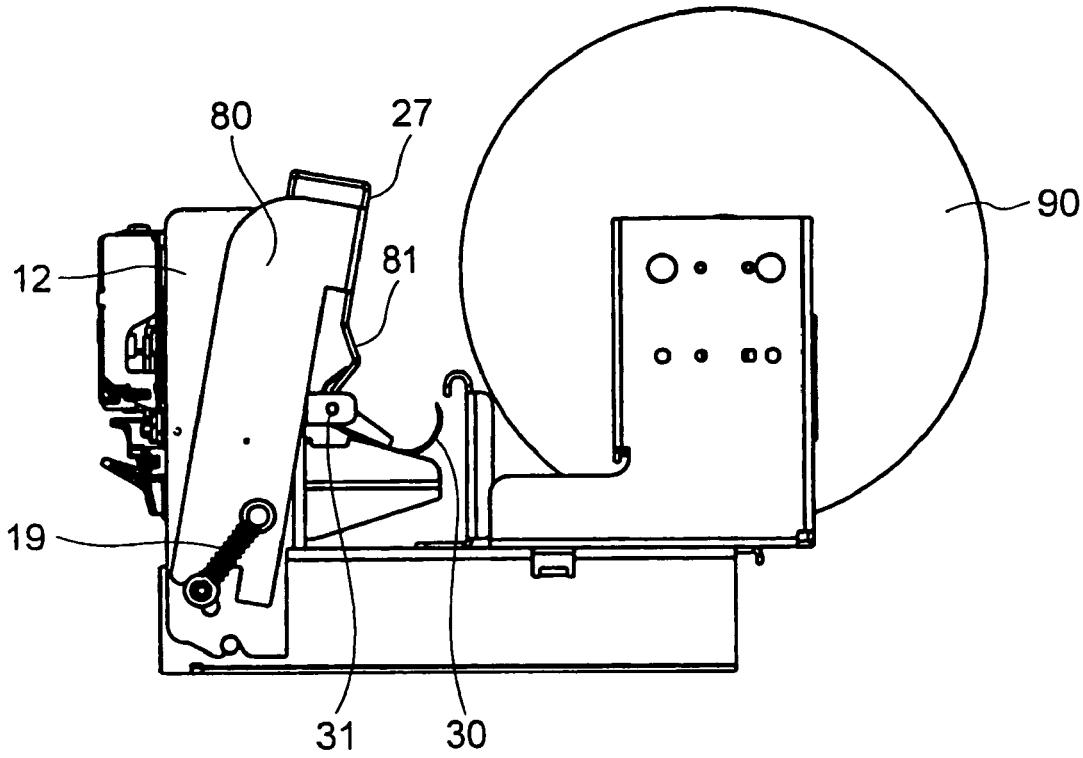
FIG. 18 is a side view of the printing unit of FIG. 17 in the locked state.
Figure 19:
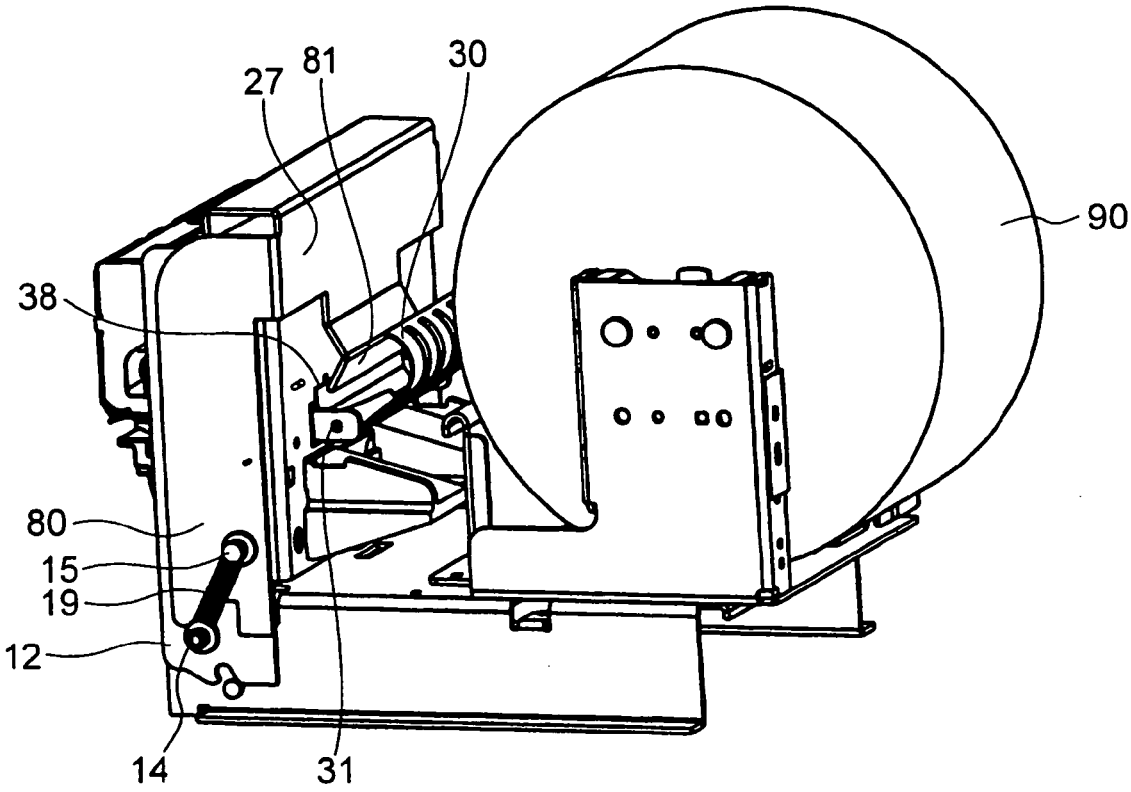
FIG. 19 is a perspective view of the printing unit of FIG. 17, showing an unlocked state of the front section.

FIGS. 17 to 19 show a printing unit according to a third embodiment of the invention. This printing unit is different from the printing units of FIGS. 1 to 16 in the buffer plate 30 escape mechanism.

In this embodiment, the release lever 80 is inclined inward by a prescribed angle in the locked state. The release lever 80 is provided with an actuator plate 81 that is bent at a prescribed angle and serves to actuate the buffer plate 30. The buffer plate 30 is pivotally supported by the movable frame 12 via the pivot shaft 31, and is provided with, in its rear, an engagement portion 38 that is bent upward and engages with the actuator plate 81.

With the above structure, when the release lever 80 is pivoted, the actuator plate 81 pushes the engagement portion 38 counterclockwise and thereby causes the buffer plate 30 to escape to the position shown in FIG. 19. In this embodiment, it is possible to cause the buffer plate 30 to escape without using a wire by a simpler mechanism than in the second embodiment. Further, whereas in the printing unit according to the second embodiment the pivotable range of the buffer plate 30 is restricted by the shape and size of the holes of the link portions 37, the printing unit according to the third embodiment is free of such a restriction.

As is understood from the above description, the invention makes it possible to replace the rolled sheet 90 from the front side of the information terminal 93 by a simple structure with which the front portion is accessible by pivoting the front section 11 including the printing mechanism 45 of the printing unit 10 by about 90° about the first shafts 14. Further, since the buffer plate 30 is caused to escape in synch with a releasing manipulation, a wide space appears after pivoting the front portion. This prevents the buffer plate 30 from being damaged and facilitates replacement of the rolled sheet 90.

Figure 20:
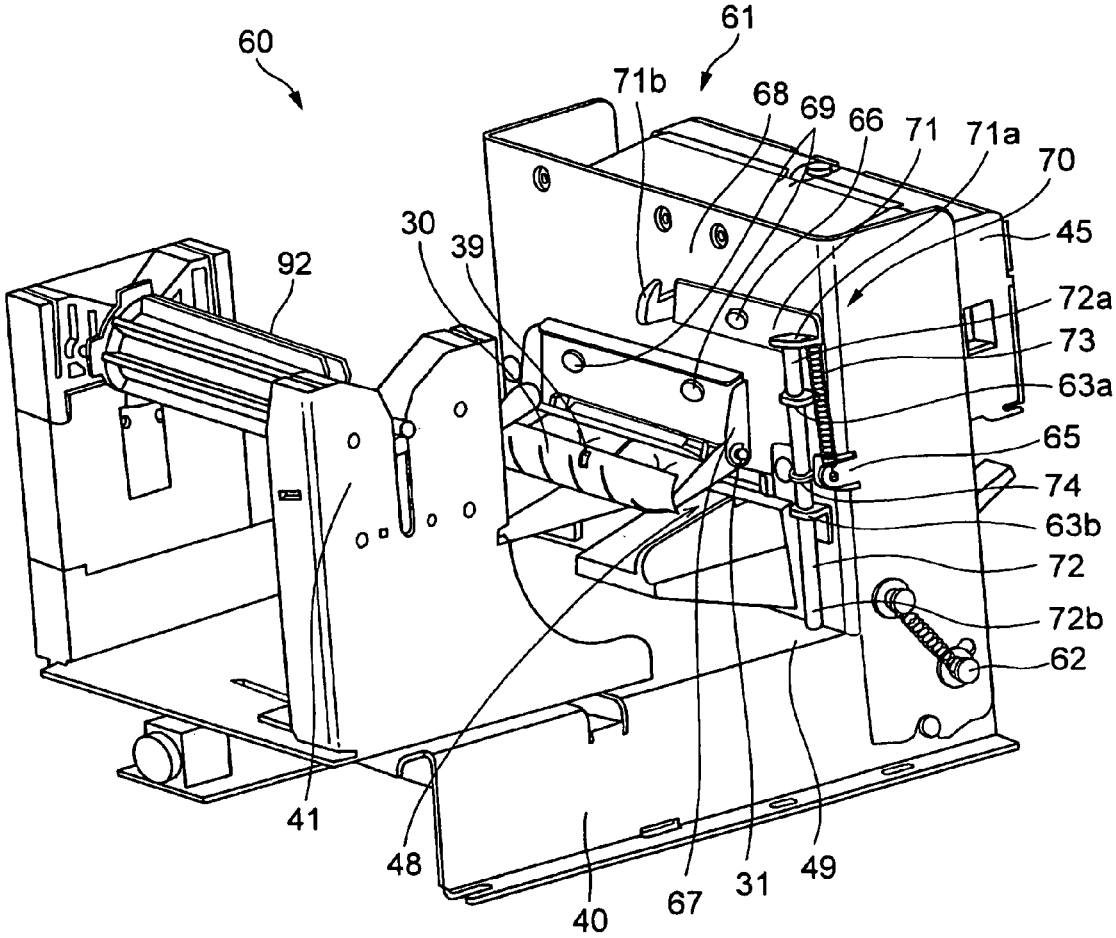
FIG. 20 is a perspective view of a printing unit according to a fourth embodiment of the invention, showing a locked state of a front section thereof.
Figure 21:
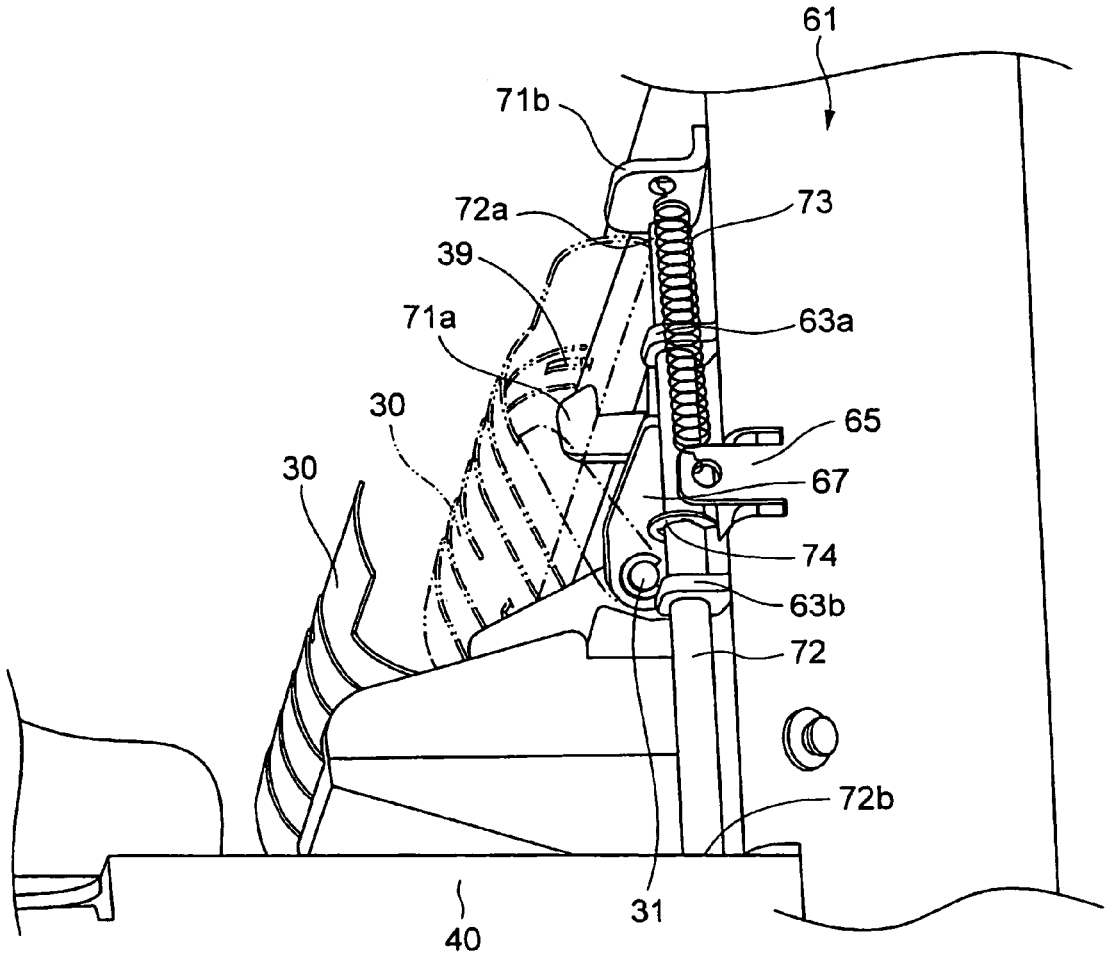
FIG. 21 is an enlarged perspective view of the front section of the printing unit of FIG. 20 in the locked state.
Figure 22:
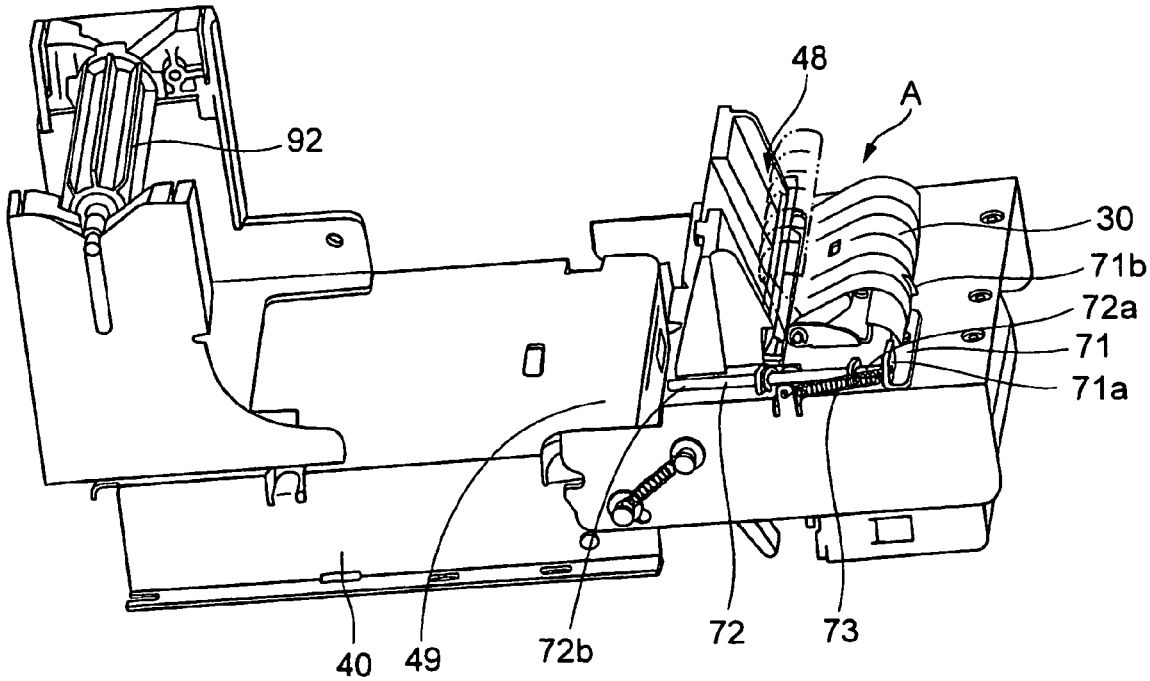
FIG. 22 is a perspective view of the printing unit of FIG. 20, showing an unlocked state of the front section.
Figure 23:
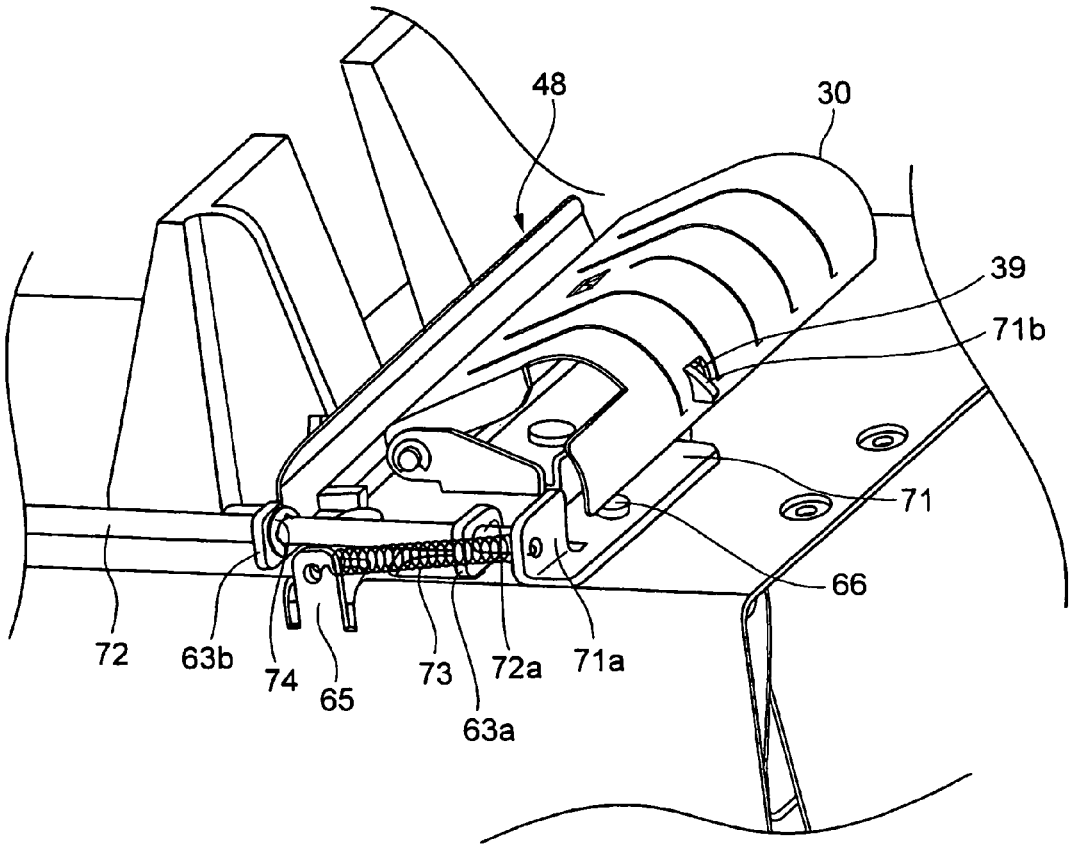
FIG. 23 is an enlarged perspective view of the front section of the printing unit of FIG. 20 in the unlocked state.

FIG. 20 shows a printing unit 60 according to a fourth embodiment of the invention having a buffer plate holding mechanism, and shows a state where the buffer plate 30 has not escaped yet. FIG. 21 shows the buffer plate holding mechanism as viewed obliquely from below in which the buffer plate 30 in an escape state is indicated by dashed chain lines. FIG. 22 shows a state where the front portion is freed by tilting a front section 61 of the printing unit 60 to the front side (outward; in FIG. 20, rightward) by 90° in which the buffer plate 30 that has not escaped yet is indicated by dashed chain lines. FIG. 23 shows the buffer plate holding mechanism in a state where the buffer plate 30 has escaped.

The printing unit 60 is provided with a rolled sheet holder 41 and a front section 61 that is pivotable outward (clockwise in FIG. 20) and is pivotably supported by pivot shafts 62 that are attached to the base frame 40. The front section 61 is provided with the printing mechanism 45, the buffer plate 30, and a mechanism 70 for holding the buffer plate 30 at an escape position. A core holder 92 for holding the core of the rolled sheet 90 is supported by the rolled sheet holder 41. The buffer plate 30 is pivotally supported by the pivot shafts 31 of support guides 67 that are fixed to a wall face 68 of the front section 61 with fixing screws 69. The buffer plate 30 is urged by an urging member (not shown) such as an elastic member so as to pivot counterclockwise (as viewed in FIG. 21). The sheet inlet 48 (see FIG. 22) through which to insert a leading end portion drawn from the rolled sheet 90 into the printing mechanism 45 is provided under the buffer plate 30.

The holding mechanism 70 is provided with a hook member 71, a hook actuator 72, and an urging member 73 such as a helical spring. The hook member 71 is pivotally supported by a pivot shaft 66 that is fixed to the wall face 68 of the front section 61, and hence is pivotable parallel with the wall face 68 of the front section 61. The hook actuator 72 is slidably supported by support guides 63*a* and 63*b* that are attached to the wall face 68.

As shown in FIG. 21, one end of the urging member 73 is connected to an engagement piece 71*a* of the hook member 71 and the other end is connected to an engagement projection 65 that extends from the side wall of the front section 61. The urging member 73 thereby urges the hook member 71 so as to rotate it clockwise parallel with the wall face 68. In this state, the engagement piece 71*a* of the hook member 71 is in contact with a top end 72*a* of the hook actuator 72. Therefore, the hook actuator 72 is pressed downward by the force of the urging member 73.

A bottom end 72*b* of the hook actuator 72 is in contact with a top face 49 of the base frame 40, and the hook actuator 72 is thus prevented from moving downward. Therefore, when the front section 61 is located at the closed position, the hook actuator 72 is in contact with the top face 49 of the base frame 40 and cannot move upward or downward any further. As a result, the hook member 71 is prevented from pivoting and stands still at the position shown in FIG. 20. When the hook member 71 is located at this position, a hook portion 71*b* that is provided at the end opposite to the engagement piece 71*a* is located under a position where it is to engage with the buffer plate 30 (see FIG. 21). The hook portion 71*b* cannot engage with an engagement hole 39 of the buffer plate 30 and hence cannot hold the buffer plate 30 at the escape position.

When the front section 61 is tilted outward by 90° from the state of FIG. 20, a state of FIG. 22 is established. As the front section 61 is pivoted, the bottom end 72*b* of the hook actuator 72 is detached from the top face 49 of the base frame 40, and the hook actuator 72 is permitted to move downward. Therefore, the hook actuator 72 is pushed by the hook member 71 which is urged by the urging member 73, and the hook actuator 72 is moved downward to a position (see FIGS. 21 and 23) where an E-ring touches the sliding support guide 63*b*. Accordingly, the hook member 71 is pivoted clockwise parallel with the wall face 68 of the front section 61, and the hook portion 71*b* is moved upward to a position (see FIG. 23) where it can engage the engagement hole 39 of the buffer plate 30. Therefore, the hook portion 71*b* is engaged with the engagement hole 39 of the buffer plate 39 by moving the buffer plate 30 to its escape position, whereby the buffer plate 30 is held at the escape position.

That is, if the buffer plate 30 located at the position indicated by dashed chain lines is moved toward the escape position manually after tilting the front section 61 to the position shown in FIG. 22, the tip of the buffer plate 30 touches the hook portion 71*b*. Since the hook portion 71*b* has a smooth slant face, if the buffer plate 30 is further moved toward the escape position, the tip of the buffer plate 30 slides on the slant face of the hook portion 71*b* and pushes down the hook portion 71*b* against the force of the urging member 73. When the buffer plate 30 is moved to the prescribed escape position, the hook portion 71*b* is engaged with the engagement hole 39 of the buffer plate 30, and the buffer plate 30 is held at the escape position. When the buffer plate 30 is held at the escape position, the sheet inlet 48 is exposed to facilitate insertion of a leading end portion 91 of the rolled sheet 90 through the sheet inlet 48.

When replacement of the rolled sheet 90 and setting of the leading end portion 91 have finished, an operator lifts up the front section 61 to the position shown in FIG. 20. As a result, the bottom end 72*b* of the hook actuator 72 touches the top face 49 of the base frame 40, and the hook actuator 72 is pushed up against the elastic force of the urging member 73. As the hook actuator 72 is pushed up, the top end 72*a* rotates the hook member 71 counterclockwise against the force of the urging member 73, and the hook portion 71*b* is moved downward. Therefore, the hook portion 71 is disengaged from the engagement hole 39, and the buffer plate 30 is automatically returned to the position shown in FIG. 20 by the guide urging member (not shown). Therefore, it is not necessary to return the buffer plate 30 to the original position manually, and a problem where an operator fails to return it does not occur.

It is possible to apply the mechanism for holding the buffer plate 30 in this embodiment to the first to third embodiments in which the buffer plate 30 is automatically moved to the escape position by the wire member, the link mechanism, or the like as the front section 61 is pivoted. In the configuration in which the buffer plate 30 is automatically caused to escape, it is not necessary to move the buffer plate 30 manually, and the risk that the buffer plate 30 is damaged due to a failure to let it escape can be lowered.

The complex wire arrangement and driving mechanism, however, increase the failure probability and the need for maintenance. In contrast, the manual escape attains the intended purpose by a simple, highly durable structure. Further, in cleaning, oiling, or the like, it may be better not to let the buffer plate 30 escape. Whether to let the buffer plate 30 escape can be determined in accordance with what type of maintenance is being carried out.

In the above embodiments of the invention, although the movable frame 12 can be unlocked by a simple manipulation of pivoting the release lever 13 in the same direction as the pivotal movement direction of the movable frame 12, a moderate load occurs in releasing the movable frame 12. That is, to unlock the movable frame 12 by pivoting the release lever 13 by more than the prescribed angle, it is necessary to lift up the entire front section 11 by a prescribed length. This prevents an event where an erroneous manipulation on the release lever 13 unlocks the movable frame 12 and causes it to tilt.

As described above, the invention provides a printer having a freeing mechanism that is safe and superior in operability though the structure is simple. Further, the invention prevents the buffer plate from being damaged and facilitates rolled sheet replacement work by causing the buffer plate to escape in synch with a freeing operation.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims

What is claimed is:

1. A printing unit, comprising:

a first frame member, having an accommodating section adapted to accommodate a rolled sheet at a rear side of the first frame member;

a print head, operable to perform printing with respect to a print sheet drawn out from the rolled sheet;

a second frame member, supporting the print head and coupled with a front side of the first frame member so as to be movable between a first position and a second position;

a locking mechanism, which locks the second frame member in the first position; and a release lever engageable with the locking mechanism, the release lever releasing the locked state of the second frame member when the release lever is pulled toward the second frame member, wherein:

at least the accommodating section is accessible when the second frame member is placed in the second position;

the release lever is pulled in the same direction that the second frame member is moved to the second position;

the release lever has an operating portion arranged between the second frame member and the accommodating section and operable to release the locked state of the second frame member;

the second frame member is pivotable between the first position and the second position; and a pivot center of the second frame member is movable when the release lever is pulled.

2. The printing unit as set forth in claim 1, wherein:

the first frame member is formed with a projection and the second frame member is formed with a groove shaped to receive the projection to lock the second frame member at the first position; and the projection is disengaged from the groove when the release lever is pulled.

3. The printing unit as set forth in claim 2, wherein:

the release lever is pivotably provided on the second frame member; and the operating portion of the release lever is brought into contact with the first frame member when the release lever is pulled, so that the pivot center is moved.

4. The printing unit as set forth in claim 3, wherein:

the first frame member is formed with a fixed pivot shaft;

the second frame member is formed with a slot receiving the fixed pivot shaft; and the operating portion of the release lever is brought into contact with the pivot shaft when the release lever is pulled.

5. The printing unit as set forth in claim 1, further comprising:

a buffer member disposed between the second frame member and the accommodating section and being movable between a third position and a fourth position;

a first urging member engaging the buffer member and urging the buffer member toward the third position, the buffer member in the third position being disposed in a sheet path of the rolled sheet such that the print sheet of the rolled sheet is curved by the buffer member; and a linker, which links the release lever and the buffer member such that the buffer member is retracted from the print sheet of the rolled sheet and moved to the fourth position when the release lever is pulled.

6. The printing unit as set forth in claim 5, wherein the linker comprises an elongated flexible member, ends of which are connected to the release lever and the buffer member, respectively.

7. The printing unit as set forth in claim 6, wherein the linker comprises at least one guide member which routes the elongated flexible member.

8. The printing unit as set forth in claim 5, wherein the buffer member is formed with a hole, and wherein the linker comprises a shaft member fined into the hole.

9. The printing unit as set forth in claim 5, wherein the buffer member comprises an engagement member, and wherein the linker comprises a plate member engaged with the engagement member.

10. The printing unit as set forth in claim 5, further comprising a retainer engageable with the buffer member to retain the buffer member at the fourth position when the second frame member is placed in the second position, wherein the retainer is disengaged from the buffer member when the second frame member is moved to the first position.

11. The printing unit as set forth in claim 10, wherein the retainer comprises:

a hook member provided on the second frame member and movable between a fifth position engaging the buffer member and a sixth position disengaging from the buffer member;

a second urging member engaging the hook member and urging the hook member toward the fifth position; and an actuator engaging the hook member and placing the hook member in the fifth position with the aid of the second urging member when the second frame member is placed in the second position, and the actuator placing the hook member in the sixth position against an urging force of the second urging member when the second frame member is placed in the first position.

12. The printing unit as set forth in claim 11, wherein:

a first end of the actuator is coupled with the hook member and a second end of the actuator is positioned to be brought into contact with the first frame member when the second frame member is placed in the first position; and the second end of the actuator is positioned to disengage from the first frame member when the second frame member is placed in the second position.

13. The printing unit as set forth in claim 12, wherein the actuator is a bar-shaped member.

* * * * *